US006048673A

United States Patent [19]

Kuramitsu et al.

[11] Patent Number: 6,048,673

[45] Date of Patent: Apr. 11, 2000

[54] SILVER HALIDE COLOR REVERSAL PHOTOGRAPHIC LIGHT-SENSITIVE MATERIAL

[75] Inventors: Masayuki Kuramitsu; Sadanobu Shuto; Shigeru Kuwashima; Makoto Yamada, all of Minami-ashigara, Japan

[73] Assignee: Fuji Photo Film Co., Ltd., Kanagawa-ken, Japan

[21] Appl. No.: 09/026,500

[22] Filed: Feb. 19, 1998

[30] Foreign Application Priority Data

Feb. 19, 1997 [JP] Japan ..... 9-049630
Feb. 19, 1997 [JP] Japan ..... 9-049631

[51] Int. Cl.[7] ..... G03C 1/46

[52] U.S. Cl. ..... 430/362; 430/504

[58] Field of Search ..... 430/504, 362

[56] References Cited

U.S. PATENT DOCUMENTS 5,378,590 1/1995 Ford et al. ..... 430/504
5,576,158 11/1996 Ford et al. ..... 430/504

*Primary Examiner*—Mark F. Huff
*Attorney, Agent, or Firm*—Birch, Stewart, Kolasch & Birch, LLP

[57] ABSTRACT

The present invention relates to a color reversal photographic light-sensitive material, and particularly to a color reversal photographic light-sensitive material improved in skin color (flesh color) reproduction. More specifically, it relates to a color reversal photographic light-sensitive material that is excellent in tone reproduction of gray and skin colors, and that also exhibits a preferable chroma (colorfulness or saturation) with respect to skin colors of different tints.

20 Claims, 3 Drawing Sheets

Schematic diagram of a spectro-sensitometer device

SILVER HALIDE COLOR REVERSAL PHOTOGRAPHIC LIGHT-SENSITIVE MATERIAL

FIELD OF THE INVENTION

The present invention relates to a color reversal photographic light-sensitive material, and particularly to a color reversal photographic light-sensitive material improved in skin color (flesh color) reproduction. More specifically, it relates to a color reversal photographic light-sensitive material that is excellent in tone reproduction of gray and skin colors, and that also exhibits a preferable chroma (colorfulness or saturation) with respect to skin colors of different tints.

Further, the present invention relates to a color reversal photographic light-sensitive material, and particularly to a color reversal photographic light-sensitive material improved in skin color reproduction. More specifically, it relates to a color reversal photographic light-sensitive material that exhibits skin color reproduction, in which the change in hue of the skin color is small and the continuity of hue of the skin color is good, ranging from low lightness to high lightness. Further, it relates to a color reversal photographic light-sensitive material that is excellent in gray reproduction, ranging from low lightness to high lightness.

BACKGROUND OF THE INVENTION

Many attempts were hitherto made to improve color reproduction in a color reversal photographic light-sensitive material.

In order to attain higher chroma and higher fidelity color reproduction, as for color negative films, correction of unwanted (side) absorption of coloring materials are generally made by masking, in which so-called colored couplers are used. On the other hand, as for color reversal photographic light-sensitive materials, the above correction of unwanted absorption of coloring materials cannot be made by masking in which the colored couplers are used. Consequently, attempts to improve color reproduction mainly by the use of the interlayer effect (interimage effect) were made, as well as improvements in spectral sensitivity and spectral absorption characteristics of coloring materials.

The interlayer effect is described by W. T. Hanson Jr. et al. in "Journal of the Optical Society of America", Vol. 42, pp. 663–669.

Examples of described methods of enhancing the interlayer effect in a color reversal film are as follows: U.S. Pat. No. 4,082,553 discloses a reversal image-forming photographic element with a layer arrangement of two or more silver halide emulsion layers positioned to permit iodide ion migration among the emulsion layers upon development, in which a surface-fogged silver halide emulsion is added in a light-sensitive emulsion layer.

JP-B-1-60135 ("JP-B" means examined Japanese patent publication) describes a color reversal photographic light-sensitive material containing blue-, green-, and red-sensitive layers, in which each of these layers has sublayers of differing sensitivity, in which the ratio of the coating silver amount of a high-sensitivity layer, or both a high-sensitivity layer and a medium-sensitivity layer, to the amount of a low-sensitivity layer, is regulated, and in which the silver iodide content of a high-sensitivity layer, or both a high-sensitivity layer and a medium-sensitivity layer, to the content of a low-sensitivity layer, is regulated, thereby to improve the interlayer effect. Further, U.S. Pat. No. 5,262, 287 describes a color reversal photographic light-sensitive material, wherein the whole light-sensitive silver halide grains in the photographic material have an average silver iodide content of 5.5 mol % or less, and wherein the said photographic material comprises means for expressing interlayer effects, the said interlayer effects at a color density of 0.5 and a color density of 1.5 satisfying a specific relationship.

However, these color reversal photographic light-sensitive materials are to generally improve the color chroma, centered on a pure color, such as red and green, but they are not intended to improve the reproduction of skin tones, which are a specific non-luminous object color.

U.S. Pat. No. 5,378,590 discloses a color reversal photographic element that contains an interlayer effect-controlling means, and that has the capacity of simultaneously reproducing a red color of high relative chroma and a yellow-tint red color (skin tones) of substantially low relative chroma.

However, this patent does not refer to the chroma relating to various skin tones, such as "a (fair) skin tone"and "a red-tint skin tone." On the contrary, the above-mentioned color reversal photographic element is not preferable for obtaining a skin tone image of high relative chroma, which is an object of the present invention.

Further, in the color reversal photographic element of the above-mentioned patent, only a relative chroma of yellowish red color (skin tone) is defined, but the hue of skin color is not referred to therein.

SUMMARY OF THE INVENTION

A first object of the present invention is to provide a color reversal photographic light-sensitive material that is excellent in skin tone reproduction, and that also exhibits a preferable chroma with respect to various skin colors of different tints.

Further, a second object of the present invention is to provide a color reversal photographic light-sensitive material that is excellent in gray and skin tone reproduction.

A third object of the present invention is to provide a color reversal photographic light-sensitive material improved in skin color reproduction. More specifically, the object is to provide a color reversal photographic light-sensitive material that is excellent in skin color reproduction, and that has a minimized change in hue of the skin color, ranging from low lightness to high lightness.

DETAILED DESCRIPTION OF THE INVENTION

Figure 1:
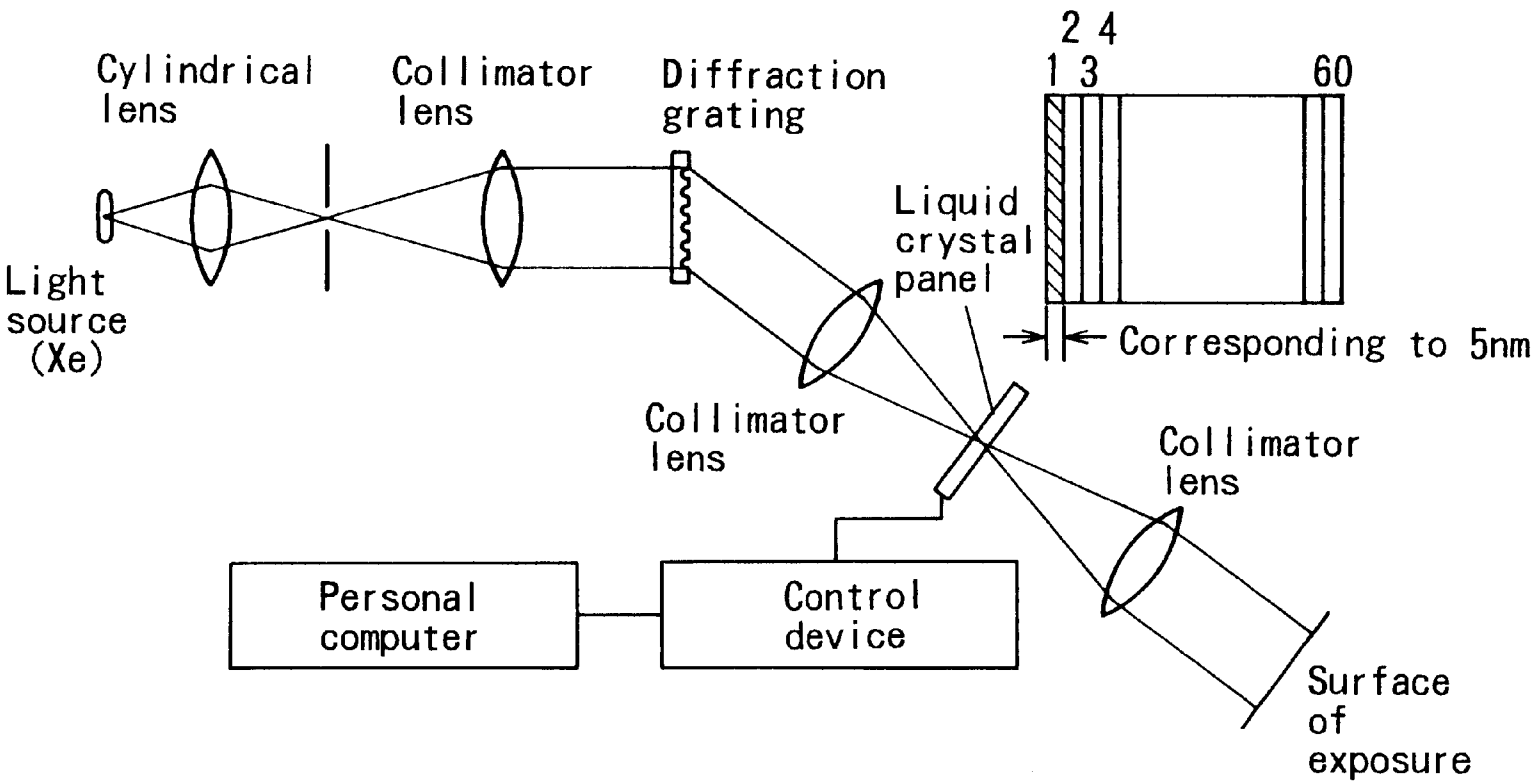
FIG. 1 is a schematic diagram of a spectro-sensitometer device.

The present inventors performed systematic luminance spectrometry of skin colors classified by races and parts of human body. Then, based on the thus-obtained data, the skin color was classified into the above-mentioned two kinds of skin colors, i.e. "(fair) skin tones" and "red-tint skin tones." As a result of intensive investigation relative to the development of a color reversal photographic light-sensitive material that can give good reproduction of these two representative skin tones, the present inventors have found that the above objects of the invention can be attained by the following:

(1) A silver halide color reversal photographic light-sensitive material, comprising a blue-sensitive emulsion layer unit, a green-sensitive emulsion layer unit, and a red-sensitive emulsion layer unit, on a transparent support, each unit comprising at least one light-sensitive silver halide emulsion layer; wherein the said light-sensitive material comprises an interlayer effect-controlling means; and wherein, when the said light-sensitive material is exposed to light of "a skin tone" and "a red-tint skin tone," each of which has the following spectral distribution, and is then subjected to development, the C* value represented by CIE Lab values of a "skin tone" image that is reproduced by the said light-sensitive material, is 23 or more, but 35 or less, when L* is in the range of from 40 to 70, and the C* value represented by CIE Lab values of a "red-tint skin tone" image that is reproduced by the said light-sensitive material, is 20 or more, but 30 or less at L*=20, and 30 or more, but 40 or less at L*=40.

TABLE 1

| Wave-length (nm) | Spectral reflectance Skin tone | Spectral reflectance Red-tint skin tone |
|---|---|---|
| 400 | 0.1687 | 0.1315 |
| 405 | 0.1621 | 0.1203 |
| 410 | 0.1611 | 0.1204 |
| 415 | 0.1577 | 0.1192 |
| 420 | 0.1560 | 0.1191 |
| 425 | 0.1570 | 0.1201 |
| 430 | 0.1605 | 0.1195 |
| 435 | 0.1675 | 0.1254 |
| 440 | 0.1809 | 0.1311 |
| 445 | 0.1937 | 0.1360 |
| 450 | 0.2044 | 0.1400 |
| 455 | 0.2105 | 0.1440 |
| 460 | 0.2184 | 0.1495 |
| 465 | 0.2223 | 0.1554 |
| 470 | 0.2279 | 0.1654 |
| 475 | 0.2337 | 0.1716 |
| 480 | 0.2397 | 0.1763 |
| 485 | 0.2439 | 0.1798 |
| 490 | 0.2490 | 0.1862 |
| 495 | 0.2546 | 0.1996 |
| 500 | 0.2625 | 0.2090 |
| 505 | 0.2685 | 0.2149 |
| 510 | 0.2802 | 0.2195 |
| 515 | 0.2853 | 0.2203 |
| 520 | 0.2893 | 0.2160 |
| 525 | 0.2931 | 0.2050 |
| 530 | 0.2932 | 0.1927 |
| 535 | 0.2967 | 0.1839 |
| 540 | 0.2993 | 0.1797 |
| 545 | 0.2994 | 0.1816 |
| 550 | 0.2999 | 0.1872 |
| 555 | 0.3022 | 0.1968 |
| 560 | 0.3041 | 0.2016 |
| 565 | 0.3056 | 0.1976 |
| 570 | 0.3103 | 0.1902 |
| 575 | 0.3095 | 0.1803 |
| 580 | 0.3136 | 0.1827 |
| 585 | 0.3272 | 0.2112 |
| 590 | 0.3450 | 0.2616 |
| 595 | 0.3630 | 0.3217 |
| 600 | 0.3841 | 0.3743 |
| 605 | 0.3970 | 0.4123 |
| 610 | 0.4106 | 0.4475 |
| 615 | 0.4187 | 0.4690 |
| 620 | 0.4273 | 0.4950 |

TABLE 1-continued

| Wave-length (nm) | Spectral reflectance Skin tone | Spectral reflectance Red-tint skin tone |
|---|---|---|
| 625 | 0.4398 | 0.5162 |
| 630 | 0.4458 | 0.5268 |
| 635 | 0.4548 | 0.5390 |
| 640 | 0.4615 | 0.5458 |
| 645 | 0.4755 | 0.5712 |
| 650 | 0.4796 | 0.5824 |
| 655 | 0.4858 | 0.5848 |
| 660 | 0.4913 | 0.5910 |
| 665 | 0.4988 | 0.6030 |
| 670 | 0.5041 | 0.6079 |
| 675 | 0.5034 | 0.6058 |
| 680 | 0.4991 | 0.6067 |
| 685 | 0.5043 | 0.6112 |
| 690 | 0.5072 | 0.6122 |
| 695 | 0.5163 | 0.6171 |
| 700 | 0.5189 | 0.6165 |

(2) The silver halide color reversal photographic light-sensitive material as described in (1), wherein, for the characteristic curves of each of the color-sensitive emulsion layer units, the point-gamma value at the color density of 2.0 is 1.8 or more, but 2.5 or less, the point-gamma value at the color density of1.0 is 1.3 or more, but 1.8 or less, and the point-gamma value at the color density of 0.5 is 0.7 or more, but 1.1 or less.

(3) The silver halide color reversal photographic light-sensitive material as described in (1) or (2), wherein, when the said light-sensitive material is exposed to light of a "gray" having the following spectral distribution, and is then subjected to development, the C* value represented by CIE Lab values of a "gray" image that is reproduced by the said light-sensitive material, is 0 or more, but 10 or less, when L* is in the range of 10 or more, but 80 or less.

TABLE 2

| Wave-length (nm) | Spectral reflectance Gray |
|---|---|
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |

TABLE 2-continued

| Wave-length (nm) | Spectral reflectance Gray |
|---|---|
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874 |

(hereinafter the silver halide color reversal photographic light-sensitive materials stated in the above (1), (2), and (3) are referred to as first invention of the present invention.)

(4) A silver halide color reversal photographic light-sensitive material, comprising a blue-sensitive emulsion layer unit, a green-sensitive emulsion layer unit, and a red-sensitive emulsion layer unit, on a transparent support, each unit comprising at least one light-sensitive silver halide emulsion layer; wherein the said light-sensitive material comprises an interlayer effect-controlling means; and wherein, when the said light-sensitive material is exposed to light having the following spectral distribution of "a skin tone" and "a red-tint skin tone," and is then subjected to development, the standard deviation of hue angle in the CIE Lab color specification system of a "skin tone" image and a "red-tint skin tone" image, that are reproduced by the said light-sensitive material, is within 1.0, respectively, in the range of L*=20 to 70, and the maximum difference in the hue angle in the CIE Lab color specification system between the "skin tone" image and the "red-tint skin tone" image, that are reproduced by the said light-sensitive material, is within 30° in the range of L*=20 to 70.

TABLE 3

| Wave-length (nm) | Spectral reflectance Skin tone | Red-tint skin tone |
|---|---|---|
| 400 | 0.1687 | 0.1315 |
| 405 | 0.1621 | 0.1203 |
| 410 | 0.1611 | 0.1204 |
| 415 | 0.1577 | 0.1192 |
| 420 | 0.1560 | 0.1191 |
| 425 | 0.1570 | 0.1201 |
| 430 | 0.1605 | 0.1195 |
| 435 | 0.1675 | 0.1254 |
| 440 | 0.1809 | 0.1311 |
| 445 | 0.1937 | 0.1360 |
| 450 | 0.2044 | 0.1400 |
| 455 | 0.2105 | 0.1440 |
| 460 | 0.2184 | 0.1495 |
| 465 | 0.2223 | 0.1554 |
| 470 | 0.2279 | 0.1654 |
| 475 | 0.2337 | 0.1716 |
| 480 | 0.2397 | 0.1763 |
| 485 | 0.2439 | 0.1798 |
| 490 | 0.2490 | 0.1862 |
| 495 | 0.2546 | 0.1996 |
| 500 | 0.2625 | 0.2090 |
| 505 | 0.2685 | 0.2149 |
| 510 | 0.2802 | 0.2195 |
| 515 | 0.2853 | 0.2203 |
| 520 | 0.2893 | 0.2160 |
| 525 | 0.2931 | 0.2050 |
| 530 | 0.2932 | 0.1927 |
| 535 | 0.2967 | 0.1839 |
| 540 | 0.2993 | 0.1797 |
| 545 | 0.2994 | 0.1816 |
| 550 | 0.2999 | 0.1872 |
| 555 | 0.3022 | 0.1968 |
| 560 | 0.3041 | 0.2016 |
| 565 | 0.3056 | 0.1976 |
| 570 | 0.3103 | 0.1902 |
| 575 | 0.3095 | 0.1803 |
| 580 | 0.3136 | 0.1827 |
| 585 | 0.3272 | 0.2112 |
| 590 | 0.3450 | 0.2616 |
| 595 | 0.3630 | 0.3217 |
| 600 | 0.3841 | 0.3743 |
| 605 | 0.3970 | 0.4123 |
| 610 | 0.4106 | 0.4475 |
| 615 | 0.4187 | 0.4690 |
| 620 | 0.4273 | 0.4950 |
| 625 | 0.4398 | 0.5162 |
| 630 | 0.4458 | 0.5268 |
| 635 | 0.4548 | 0.5390 |
| 640 | 0.4615 | 0.5458 |
| 645 | 0.4755 | 0.5712 |
| 650 | 0.4796 | 0.5824 |
| 655 | 0.4858 | 0.5848 |
| 660 | 0.4913 | 0.5910 |
| 665 | 0.4988 | 0.6030 |
| 670 | 0.5041 | 0.6079 |
| 675 | 0.5034 | 0.6058 |
| 680 | 0.4991 | 0.6067 |
| 685 | 0.5043 | 0.6112 |
| 690 | 0.5072 | 0.6122 |
| 695 | 0.5163 | 0.6171 |
| 700 | 0.5189 | 0.6165 |

(5) The silver halide color reversal photographic light-sensitive material as described in (4), wherein, when the said light-sensitive material is exposed to light having the following spectral distribution of a "gray", and is then subjected to development, the C* value represented by CIE Lab values of a "gray" image that is reproduced by the said light-sensitive material, is 0 or more, but 10 or less, in the range of L*=10 to 80.

TABLE 4

| Wave-length (nm) | Spectral reflectance Gray |
|---|---|
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874 |

(hereinater the silver halide color reversal photographic light-sensitive materials stated in the above (4) and (5) are referred to as second invention of the present invention.)

In this specification, "the present invention" denotes both the above first and second inventions, unless otherwise specified.

The spectral reflectances of "gray," "skin tone," and "red-tint skin tone" referred to in the present invention are shown in the above Tables 1, 2, 3, and 4. As for the spectral reflectance of "gray," measured values of Munsell color standard N5 were used.

In the present invention, the spectral distribution under the standard illumination of each of the colors (relative spectral luminance) was calculated from the above-described spectral reflectance multiplied by the spectral distribution of an ISO sensito-metric daylight source ($D_{55}$).

The spectral distribution can be generated by a spectro-sensitometer device that is able to produce any of the spectral distributions by using an intensity modulating-type mask formed by arranging liquid crystal panels in the stripe form, and further by electrically controlling the transmittance of each of the liquid crystal segments.

The spectro-sensitometer device that is able to generate the above-described spectral distribution can be prepared with reference to the reports presented by Enomoto et al. in the Annual Meeting of SPSTJ (Nihon Shashin Gakkai) '90.

FIG. 1 shows a block diagram of the device mainly showing its optical system, and a schematic diagram of the liquid crystal mask. A xenon arc lamp having a high luminance is used as a light source, and in addition, a cylindrical lens was used in the optical system, thereby obtaining a long slit light extended to the grating direction of a diffraction grating. A light separated by a transmission-type diffraction grating acts as a spectral face having a wavelength region of from 400 nm to 700 nm at the dispersion face. Onto this spectral face, are placed liquid crystal panels composed of 60 segments, in which 1 segment is 5 nm, and transmittance is controlled at intervals of 5 nm, thereby obtaining an objective spectral distribution. A color-mixed slit light is formed on the surface of exposure to light, and the exposure to light is performed by scanning a light-sensitive material, on which an optical wedge is placed, at an orthogonal angle to the slit light.

The measurement of "gray," "skin tone," and "red-tint skin tone," each of which is reproduced by a light-sensitive material of the present invention, was carried out under the observational condition based on an isochromatic test in which twice sight (2-degree colorimetric observation) was adopted at the 1931 CIE (Commission International de I'Eclairage) Conference.

Further, to calculate CIE Lab values, the CIE 976 (L*, a*, b*) isometric perceptive color space alculations were used. For a more detailed explanation of the above-mentioned calculations, reference can be made to, for example, *New-Edition Color Science Handbook*, edited by the publication party of Tokyo University (1980), Chapter 4.

In the present invention, for the evaluation of "gray," "skin tone," and "red-tint skin tone" images, correction is necessary so that the C* value represented by the CIE Lab values of the "gray" image is 0.5 or less at L*=40. For example, the correction can be made using a commercially available color compensating filter. Alternatively, as the method described in U.S. Pat. No. 5,378,590, the CIE Lab values for the "gray," "skin tone," and "red-tint skin tone" images can be also re-calculated and evaluated by resealing the tristimulus values X, Y and Z, with L* of the "gray" image being 40, as the reference white. Among these, correction at the time of exposure to light is preferred.

The maximum value of the C* value represented by he CIE Lab values of the "(fair) skin tone" image that is reproduced by a light-sensitive material of the first invention is from 23 to 35, preferably from 25 to 35, and more preferably from 27 to 35, with L being in the range of from 40 to 70. When the maximum value of the C* value is too small, the skin color looks somber and drab, which is not preferable. Particularly, the shade part of the skin color looks darkish, which is not preferable. On the other hand, when the maximum value is too large, the skin color looks too vivid, which is unnatural.

The C* value represented by the CIE Lab values of the "red-tint skin tone" image that is reproduced by a light-sensitive material of the first invention, is from 20 to 30, preferably from 20 to 28, and more preferably from 20 to 26, at L*=20. When the C* value is too small, the shade part of the skin color is so dark and drab that the skin tone reproduction looks unnatural. In contrast, when the C* value is too large, the red tint of the "red-tint skin tone" is undesirably over-stressed.

The C* value represented by the CIE Lab values of the "red-tint skin tone" image that is reproduced by a light-sensitive material of the first invention, is from 30 to 40, preferably from 30 to 38, and more preferably from 30 to 36, at L*=40. When the C* value is too small, the "red-tint skin tone" unpreferably looks somber and drab. In contrast, when the C* value is too large, the red tint of the "red-tint skin tone" is undesirably over-stressed.

The C* value represented by the CIE Lab values of the "gray" image that is reproduced by a light-sensitive material of the first invention, is generally from 0 to 10, preferably from 0 to 7, and more preferably from 0 to 5, when L* is in the range of from 10 to 80. When the C* value is too large, the "gray" image is not reproduced as "gray," which is not preferable.

The term "characteristic curve" referred to in the first invention means a so-called D-logE curve obtained by plotting logE (E is an exposure amount) on the axis of abscissas, and D (color density) on the axis of ordinates, which is minutely described by, for example, T. H. James (Ed.) in *The Theory of the Photographic Process,* 4th Edition, pp. 501 to 509. Further, the term "point-gamma" referred to in the present invention is defined by the equation described in page 502 of the above-cited textbook:

$$\text{Point-gamma}=dD/d\log E.$$

It also means a differential value at an arbitrary point on the characteristic curve.

The characteristic curve referred to in the first invention is determined according to the test method illustrated below.

(1) Test conditions

The test is carried out in a completely dark room at a temperature of 23±5 °C. and a relative humidity of 50±20%. The light-sensitive materials for the test are used after they have stood at this state for at least 1 hour.

(2) Light exposure conditions

The light-sensitive materials for the test are exposed to light according to the light exposure conditions described in International Standard: ISO 2240 "Photography-Colour reversal camera films-Determination of ISO speed"

(3) Processing conditions

During the time period from light exposure to development processing, the light-sensitive materials for the test are kept at a temperature of 23±5 °C. and a relative humidity of 50±20%. The development processing is finished in a time period of from 30 min. to 6 hrs. after the light exposure. The processing is carried out according to the steps illustrated below.

(Processing Steps and Processing Solutions in a Standard Development Processing)

| Processing step | Time | Temperature | Tank volume | Replenisher amount |
|---|---|---|---|---|
| 1st development | 6 min | 38° C. | 12 liters | 2,200 ml/m$^2$ |
| 1st water-washing | 2 min | 38° C. | 4 liters | 7,500 ml/m$^2$ |
| Reversal | 2 min | 38° C. | 4 liters | 1,100 ml/m$^2$ |
| Color development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 12 liters | 220 ml/m$^2$ |
| Fixing | 4 min | 38° C. | 8 liters | 1,100 ml/m$^2$ |
| 2nd water-washing | 4 min | 38° C. | 8 liters | 7,500 ml/m$^2$ |
| Final-rinsing | 1 min | 25° C. | 2 liters | 1,100 ml/m$^2$ |

Compositions of each processing solution used were as follows:

| | Tank solution | Replenisher |
|---|---|---|
| First developer | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Potassium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |

| Reversal solution (Both tank solution and replenisher) | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |
| (pH was adjusted by using acetic acid or sodium hydroxide) | |

| | Tank solution | Replenisher |
|---|---|---|
| Color developer | | |
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline.3/2 sulfate. mono hydrate | 11 g | 11 g |
| 3,6-Dithiaoctane-1,8-diol | 1.0 g | 1.0 g |

-continued

| | | |
|---|---|---|
| Water to make | 1,000 ml | 1,000 ml |
| pH | 11.80 | 12.00 |
| (pH was adjusted by using sulfuric acid or potassium hydroxide) | | |
| Pre-bleaching solution | | |
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde · sodium bisulfite adduct | 30 g | 35 g |
| Water to make | 1,000 ml | 1,000 ml |
| pH | 6.30 | 6.10 |
| (pH was adjusted by using acetic acid or sodium hydroxide) | | |
| Bleaching solution | | |
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1.000 ml |
| pH | 5.70 | 5.50 |
| (pH was adjusted by using nitric acid or sodium hydroxide) | | |
| Fixing solution (Both tank solution and replenisher) | | |
| Ammonium thiosulfate | 80 g | |
| Sodium sulfite | 5.0 g | |
| Sodium bisulfite | 5.0 g | |
| Water to make | 1,000 ml | |
| pH | 6.60 | |
| (pH was adjusted by using acetic acid or aqueous ammonia) | | |
| | Tank solution | Reple-nisher |
| Stabilizing solution | | |
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

(4) Densitometric Measurement

The density is represented by $\log_{10}(\phi_0/\phi)$, in which $\phi_0$ is an illumination luminous flux for the densitometric measurement, and $\phi$ is a transmission luminous flux at the measurement spot. Geometric conditions of the densitometric measurement are that the illumination luminous flux should be a parallel luminous flux to the direction of a normal line. Further, it is standardized to use all of the luminous flux transmitted as a transmission luminous flux, followed by extension to a semispace. When another method of measurement is used, correction is made by using a standard density patch. Further, at the time of measurement, the surface of an emulsion membrane faces the side of a light-sensitive device. For the densitometric measurement, three color densities of R, G, and B are each measured using a respective Status A filter.

The densities obtained by the above-mentioned light exposure, development processing, and densitometric measurement are plotted as each of densities of R, G, and B versus the common logarithm of exposure (logE), so that a density function curve is determined.

In the first invention, regarding the characteristic curve of every color-sensitive emulsion layer unit, the value of point-gamma at the color density of 2.0 is generally from 1.8 to 2.5, preferably from 1.8 to 2.3, and more preferably from 1.8 to 2.2. Further, regarding the characteristic curve of every color-sensitive emulsion layer unit, the value of point-gamma at the color density of1.0 is generally from 1.3 to 1.8, preferably from 1.3 to 1.7, and more preferably from 1.4 to 1.7. Furthermore, regarding the characteristic curve of every color-sensitive emulsion layer unit, the value of point-gamma at the color density of 0.5 is generally from 0.7 to 1.1, preferably from 0.8 to 1.0, and more preferably from 0.9 to 1.0.

Preferably, the standard deviation of the hue angle in the CIE Lab color specification system of the "skin tone" and the "red-tint skin tone" reproduced by a light-sensitive material of the first invention is not more than 1.0 in the range of L*=20 to 70, respectively, and in addition, the maximum difference in the hue angle in the CIE Lab color specification system between the "skin tone" and the "red-tint skin tone" reproduced by the light-sensitive material is not more than 30 degrees in the range of L* =20 to 70.

The value of the standard deviation of the hue angle represented by the CIE Lab values of the "skin tone" image and the "red-tint skin tone" image, that are reproduced by a light-sensitive material of the second invention, is within 1.0, preferably within 0.6, and more preferably within 0.4, respectively, in the range of L*=20 to 70. The smaller this value is, the smaller and more preferable the change in hue of the skin color is, ranging from low lightness to high lightness, which results in preferable color reproduction.

Further, the maximum difference in the hue angle in the CIE Lab color specification system of the "skin tone" and the "red-tint skin tone," that are reproduced by a light-sensitive material of the second invention, is within 30°, preferably within 25°, and more preferably within 20°, in the range of L*=20 to 70. When the maximum difference is too large, red-tinged deviation in the skin tone tends to noticeably arise, which is not desirable for the skin color reproduction.

The above-mentioned definition of the value of the standard deviation of the hue angle represented by the CIE Lab values of the "skin tone" image and the "red-tint skin tone" image, and also the definition of the maximum difference in the hue angle in the CIE Lab color specification system of "skin tone" and "red-tint skin tone," are preferably effected in the range of L*=20 to 70. Alternatively, they may also be effected in the range of L*=30 to 65, or in the range of L*=40 to 65.

The value of the hue angle represented by the CIE Lab values of the "(fair) skin tone" image, that is reproduced by a light-sensitive material of the second invention, is preferably from 50° to 70°, and more preferably from 55° to 65°, in the range of L*=20 to 70.

Further, the value of the hue angle represented by the CIE Lab values of the "red-tint skin tone" image, that is reproduced by a light-sensitive material of the second invention, is preferably from 40° to 60°, and more preferably from 40° to 50°, in the range of L*=20 to 70.

The C* value represented by the CIE Lab values of the "gray" image that is reproduced by a light-sensitive material of the second invention, is generally from 0 to 10, preferably from 0 to 7, and more preferably from 0 to 5, with L* being in the range of from 10 to 80. The smaller the C* value is, the better and more preferable the reproduction of "gray" is, ranging from low lightness to high lightness.

The C* value represented by the CIE Lab values of the "skin tone" image that is reproduced by a light-sensitive material of the second invention, is preferably from 26 to 35, more preferably from 28 to 35, and further preferably from 30 to 35, with L* being in the range from 40 to 70.

Further, the C* value represented by the CIE Lab values of the "red-tint skin tone" image that is reproduced by a light-sensitive material of the second invention, is preferably from 20 to 30, more preferably from 20 to 28, and further preferably from 20 to 26, at L* =20. Further, the C* value represented by the CIE Lab values of the "red-tint skin tone" image that is reproduced by a light-sensitive material of the second invention, is preferably from 30 to 40, more preferably from 30 to 38, and further more preferably from 30 to 36, at L*=40.

As for the interlayer effect-controlling means for use in the present invention, in the same manner as a method generally applied to a color reversal light-sensitive material, two or more silver halide emulsion layers are positioned to permit iodide ion migration among the emulsion layers upon development, and moreover, each of the silver iodide content, the emulsion grain size, the emulsion grain shape, and the emulsion coating amount of the respective silver halide emulsion are optimized, thereby a desirable interlayer effect can be obtained.

As one of the interlayer effect-controlling means for use in the present invention, preferably, silver halide grains whose surface and/or interior (inner part) are fogged, are incorporated in at least one layer of the color-sensitive emulsion layer unit, and/or at least one layer adjacent to the color-sensitive emulsion layer unit. Further, the color-sensitive emulsion layer unit may contain an auxiliary layer sandwiched between the emulsion layers having the same color-sensitivity.

The term "silver halide grains whose surface and/or interior are fogged" referred to in the present invention means silver halide grains prepared by chemically or optically fogging the surface and/or the interior thereof, so that they are capable of being subjected to development independently of exposure.

The silver halide grains whose surface is fogged (surface-fogged-type silver halide grains) may be prepared by chemically or optically fogging these silver halide grains in the course of silver halide grain formation and/or after the grain formation.

The above-mentioned fogging step may be carried out by, for example, a method in which a reducing agent or a gold salt is added under suitable conditions of pH and pAg, or a method in which heating is carried out under a low pAg, or a method in which a uniform exposure is applied. Examples of the reducing agent to be used include stannous chloride, hydrazine-series compounds, ethanolamine, and thiourea dioxide.

Preferably, the fogging step using these fogging (nucleating) materials is carried out prior to a washing step for the purpose of, for example, preventing fog on standing, which fog is caused by diffusion of the fogging material into a light-sensitive emulsion layer.

On the other hand, silver halide grains whose interior is fogged (internally-fogged-type silver halide grains) may be prepared by forming a shell onto the surface of the above-described surface-fogged-type silver halide grains, each of which is used as a core. A detailed explanation relative to the internally-fogged-type silver halide grains is given in JP-A-59-214852 ("JP-A" used herein means an unexamined published Japanese patent application). As for the internally-fogged-type silver halide grains, the effect on sensitization can be controlled by adjusting the thickness of the shell.

Further, the internally-fogged-type silver halide grains may also be prepared by forming core grains fogged from the initial stage of the grain formation, in the same manner as in the above-described fogging method, followed by covering the resultant fogged core grains with an unfogged shell. As occasion demands, the silver halide grains may be fogged wholly from the interior to their surface.

These fogged silver halide grains may be any of silver chloride, silver bromide, silver chlorobromide, silver iodobromide, and silver chloroiodobromide, with preferred examples being silver bromide and silver iodobromide. In this case, the silver iodide content is preferably not more than 5 mol %, and more preferably not more than 2 mol %. Further, these fogged silver halide grains may have an internal structure whose halogen composition is different, in the grains interior.

The average grain size of the fogged silver halide grains for use in the present invention is not limited in particular, but preferably, it is smaller than the average grain size of light-sensitive silver halide grains incorporated in a color-sensitive emulsion layer unit to which the fogged silver halide grains are added. Further, it is preferable that, when the fogged silver halide grains are added to a layer adjacent to a color-sensitive emulsion layer unit, the average grain size of the fogged silver halide grains is smaller than that of light-sensitive silver halide grains in an emulsion layer adjacent to the layer in which the fogged silver halide grains are added. Specifically, the average grain size of the fogged silver halide grains is preferably from 0.05 $\mu$m to 0.5 $\mu$m, more preferably from 0.05 $\mu$m to 0.3 $\mu$m, and most preferably from 0.05 $\mu$m to 0.2 $\mu$m.

Further, the shape of these fogged silver halide grains is not limited in particular, and they may be regular grains or irregular grains. Further, the grain size distribution of these fogged silver halide grains may be polydispersed or monodispersed, with the latter being more preferred.

The amount of these fogged silver halide grains to be used can be changed optionally in accordance with the degree necessary in the present invention, but the amount is preferably from 0.05 to 50 mol %, and more preferably from 0.1 to 25 mol %, in terms of a percentage based on a total amount of light-sensitive silver halide incorporated in all layers of a color photographic light-sensitive material of the present invention.

In a preferable embodiment of the interlayer effect-controlling means for use in the present invention, a colloidal silver is added to at least one layer of the color-sensitive emulsion layer unit and/or at least one layer adjacent to the color-sensitive emulsion layer unit.

The above-described colloidal silver may be any color of yellow, brown, and black, but preferably it assumes a yellow color whose maximum absorption wavelength is from 400 nm to 500 nm, and more preferably from 430 nm to 460 nm.

With respect to preparation of various types of the colloidal silver, reference can be made to, for example, Weiser, *Colloidal Elements,* Wiley & Sons, New York (1933) (yellow colloidal silver prepared by a Carey Lea's dextrin reduction method), German Patent No. 1,096,193 (a brown or black colloidal silver), and U.S. Pat. No. 2,688,601 (a blue colloidal silver).

In the present invention, the amount of the colloidal silver to be used is preferably from 0.001 to 0.4 g/m$^2$, and more preferably from 0.003 to 0.3 g/m$^2$, per each of layers to which the colloidal silver is added.

In the present invention, the surface- and/or internally-fogged silver halide grains, or the colloidal silver, may be incorporated in any of the color-sensitive emulsion layer units, or a layer adjacent to the color-sensitive emulsion layer unit, but preferably they are incorporated in at least one layer of all of the color-sensitive emulsion layer units and/or at least one layer of all of the layers adjacent to the color-sensitive emulsion layer units.

The surface-fogged-type silver halide grains, the internally-fogged-type silver halide grains, and the colloidal silver may each be used alone, or they may be used in combination.

Preferably, the surface-fogged-type silver halide grains and the colloidal silver are contained in a layer adjacent to the color-sensitive emulsion layer unit. When each of the color-sensitive emulsion layer units is composed of two or more emulsion layers differing in speed, spectral sensitivity, or other photographic properties, the surface-fogged-type silver halide grains and the colloidal silver are preferably incorporated in a layer adjacent to the emulsion layer having the lowest sensitivity of each of the color-sensitive emulsion layer units.

On the other hand, the internally-fogged-type silver halide grains are preferably incorporated in a color-sensitive emulsion layer unit. When each of the color-sensitive emulsion layer units is composed of two or more emulsion layers differing in speed, spectral sensitivity, or other photographic properties, the internally-fogged-type silver halide grains are preferably incorporated in the emulsion having the lowest sensitivety layer and/or a low-sensitive emulsion layer that is more sensitive than the emulsion layer having the lowest sensitivety (but its sensitivity is lower than others), of each of the color-sensitive emulsion layer units.

In a preferable embodiment of the interlayer effect-controlling means for use in the present invention, internal latent image-type silver halide grains, which are capable of forming a latent image predominantly on the interior of the silver halide grains, are incorporated in at least one layer of the color-sensitive emulsion layer unit.

As examples for the internal latent image-type silver halide grains, preferably used are core/shell-type internal latent image-type silver halide emulsions, as described in JP-A-63-264740. A method of preparing the core/shell type internal latent image-type emulsion is described minutely in JP-A-59-133542. The thickness of the shell of the internal latent image-type emulsion is not limited in particular, but it is preferably from 3 to 40 nm, and especially preferably from 5 to 20 nm.

When each of the color-sensitive emulsion layer units is composed of two or more emulsion layers differing in speed, spectral sensitivity, or other photographic properties, the internal latent image-type silver halide grains are preferably incorporated in the emulsion layer having the lowest sensitivity of each of the color-sensitive emulsion layer units and/or a low-sensitive emulsion layer that is more sensitive than the emulsion layer having the lowest sensitivity (but its sensitivity is lower than other layers).

In a preferable embodiment of the interlayer effect-controlling means for use in the present invention, a color reversal photographic light-sensitive material contains a DIR compound described in U.S. Pat. Nos. 3,364,022 and 3,379,529, JP-B-6-21942, JP-B-6-21943, JP-A-4-151144, and JP-A-4-359248.

These DIR compounds may be added to any of the emulsion layers and/or any of the light-insentive layers. They may be added to both the emulsion layer and the light-insensitive layer. The amount of the DIR compound to be added is preferably in the range of from 0.01 millimol/$m^2$ to 0.2 millimol/$m^2$.

In a preferable embodiment of the interlayer effect-controlling means for use in the present invention, a donor layer providing an interlayer effect (CL), which layer differs in spectral sensitivity distribution from each of the main light-sensitive layers of BL, GL, and RL, is placed adjacent to, or in close proximity to, the main light-sensitive layer, as described in U.S. Pat. Nos. 4,663,271, 4,705,744, 4,707,436, JP-A-62-160448, and JP-A-63-89850.

As various techniques and inorganic or organic materials that can also be used for the silver halide photographic emulsion for use in the present invention and the silver halide photographic light-sensitive materials wherein said silver halide photographic emulsion is used, generally those described in the Research Disclosure No. 308119 (1998) can be used.

In addition thereto, more specifically, for example, techniques and inorganic or organic materials that can also be used for color photographic light-sensitive materials to which the silver halide photographic emulsion for use in the present invention can be applied, are described in the below-shown sections in EP-A-436 938 (A2) and the below-shown patents cited therein.

| Item | Corresponding section |
|---|---|
| 1) Layer structures | page 146, line 34 to page 147, line 25 |
| 2) Silver halide emulsions | page 147, line 26 to page 148, line 12 |
| 3) Yellow couplers | page 137, line 35 to page 146, line 33, and page 149, lines 21 to 23 |
| 4) Magenta couplers | page 149, lines 24 to 28; and EP-A-421, 453 (A1), page 3, line 5 to page 25, line 55 |
| 5) Cyan couplers | page 149, lines 29 to 33; and EP-A-432, 804 (A2), page 3, line 28 to page 40, line 2 |
| 6) Polymer couplers | page 149, lines 34 to 38; and EP-A-435, 334 (A2), page 113, line 39 to page 123, line 37 |
| 7) Colored couplers | page 53, line 42 to page 137, line 34, and page 149, lines 39 to 45 |
| 8) Other functional couplers | page 7, line 1 to page 53, line 41, and page 149, line 46 to page 150, line 3; and EP-A-435, 334 (A2), page 3, line 1 to page 29, line 50 |
| 9) Antiseptics and mildewproofing agents | page 150, lines 25 to 28 |
| 10) Formalin scavengers | page 149, lines 15 to 17 |
| 11) Other additives | page 153, lines 38 to 47; and EP-A-421, 453 (A1), page 75, line 21 to page 84, line 56, and page 27, line 40 to page 37, line 40 |
| 12) Dispersion methods | page 150, lines 4 to 24 |
| 13) Supports (Bases) | page 150, lines 32 to 34 |
| 14) Film thickness and film physical properties | page 150, lines 35 to 49 |
| 15) Color development/ black-and-white development/ fogging steps | page 150, line 50 to page 151, line 47; and EP-A-442, 323 (A2), page 34, lines 11 to 54, and page 35, lines 14 to 22 |

-continued

| Item | Corresponding section |
|---|---|
| 16) Desilvering steps | page 151, line 48 to page 152, line 53 |
| 17) Automatic processors | page 152, line 54 to page 153, line 2 |
| 18) Washing/stabilizing steps | page 153, lines 3 to 37 |

The silver halide color photographic light-sensitive material of the present invention is also useful for a film unit with a lens, as described in, for example, JP-B-2-32615 and JU-B-3-39784 (the term "JU-B" used herein means an "examined Japanese utility model publication).

In the present invention, a transparent magnetic recording layer can be used.

The transparent magnetic recording layer for use in the present invention is a layer formed by coating on a base with an aqueous or organic solvent-series coating solution containing magnetic particles dispersed in a binder.

Examples of the magnetic particles for use in the present invention, can be mentioned a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape may be any of a needle shape, a rice grain shape, a spherical shape, a cubic shape, a plate-like shape, and the like. The specific surface area is preferably 20 $m^2/g$ or more, and particularly preferably 30 $m^2/g$ or more, in terms of $S_{BET}$. The saturation magnetization (σs) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or an organic material, as described in JP-A-4-259911 and 5-81652, can be used.

Next, as the binder that can be used for the magnetic particles, as described in JP-A-4-219569, a thermoplastic resin, a thermal-setting resin, a radiation-setting resin, a reactive resin, an acid-degradable polymer, an alkali-degradable polymer, a biodegradable polymer, a natural polymer (e.g. a cellulose derivative and a saccharide derivative), and a mixture of these can be used. The above resins have a glass transition temperature Tg of −40 to 300° C. and a weight-average molecular weight of 2,000 to 1,000,000. Examples include vinyl-series copolymers, cellulose derivatives, such as cellulose diacetates, cellulose triacetates, cellulose acetate propionates, cellulose acetate butylates, and cellulose tripropionates; acrylic resins, and polyvinyl acetal resins; and gelatin is also preferable. Cellulose di(tri)acetates are particularly preferable. To the binder may be added an epoxy-series, aziridine-series, or isocyanate-series crosslinking agent, to harden the binder. Examples of the isocyanate-series crosslinking agent include isocyanates, such as tolylene diisocyanate, 4,4'-diphenylmethane diisocyanate, hexamethylene diisocyanate, and xylylene diisocyanate; reaction products of these isocyanates with polyalcohols (e.g. a reaction product of 3 mol of tolylene diisocyanate with 1 mol of trimethylolpropane), and polyisocyanates produced by condensation of these isocyanates, which are described, for example, in JP-A-6-59357.

The method of dispersing the foregoing magnetic material in the foregoing binder is preferably one described in JP-A-6-35092, in which method use is made of a kneader, a pin-type mill, an annular-type mill, and the like, which may be used alone or in combination. A dispersant described in JP-A-5-088283 and other known dispersants can be used. The thickness of the magnetic recording layer is generally 0.1 to 10 μm, preferably 0.2 to 5 μm, and more preferably 0.3 to 3 μm. The weight ratio of the magnetic particles to the binder is preferably from (0.5:100) to (60:100), and more preferably from (1:100) to (30:100). The coating amount of the magnetic particles is generally 0.005 to 3 $g/m^2$, preferably 0.01 to 2 $g/m^2$, and more preferably 0.02 to 0.5 $g/m^2$. The magnetic recording layer for use in the present invention can be provided to the undersurface of the photographic base by coating or printing through all parts or in a striped fashion. To apply the magnetic recording layer, use can be made of an air doctor, a blade, an air knife, squeezing, impregnation, a reverse roll, a transfer roll, gravure, kiss, cast, spraying, dipping, a bar, extrusion, or the like. A coating solution described, for example, in JP-A-5-341436 is preferable.

The magnetic recording layer may be provided with functions, for example, of improving lubricity, of regulating curling, of preventing electrification, of preventing adhesion, and of abrading a head, or it may be provided with another functional layer that is provided with these functions. An abrasive in which at least one type of particles comprises aspherical inorganic particles having a Moh's hardness of 5 or more, is preferable. The aspherical inorganic particles preferably comprise a fine powder of an oxide, such as aluminum oxide, chromium oxide, silicon dioxide, and titanium dioxide; a carbide, such as silicon carbide and titanium carbide; diamond, or the like. The surface of these abrasives may be treated with a silane coupling agent or a titanium coupling agent. These particles may be added to the magnetic recording layer, or they may form an overcoat (e.g. a protective layer and a lubricant layer) on the magnetic recording layer. As a binder used at that time, the above-mentioned binders can be used, and preferably the same binder as used in the magnetic recording layer is used. Light-sensitive materials having a magnetic recording layer are described in U.S. Pat. Nos. 5,336,589, 5,250,404, 5,229,259, and 5,215 874, and EP-466 130.

Polyester bases for use in the present invention will be further described, and details, including light-sensitive materials, processing, cartridges, examples, etc., are described later in this specification but also described in Kokaigiho, Kogi No. 94-6023 (Hatsumei-kyokai; 15, 3, 1994). Polyesters for use in the present invention are produced by using, as essential components, diols and aromatic dicarboxylic acids. Examples of the aromatic dicarboxylic acids include 2,6-, 1,5-, 1,4- and 2,7-naphthalene dicarboxylic acids; terephthalic acid, isophthalic acid, and phthalic acid; and examples of the diols include diethylene glycol, triethylene glycol, cyclohexanedimethanol, bisphenol A, and bisphenols. Examples of their polymers include homopolymers, such as polyethylene terephthlates, polyethylene naphthalates, and polycyclohexanedimethanol terephthalates. Polyesters comprising 2,6-naphthalenedicarboxylic acid as an acidic reaction component, at a content of 50 to 100 mol % of the total dicarboxylic acid component, are particularly preferable. Among them, polyethylene 2,6-naphthalates are particularly preferable. The average molecular weight is in the range of generally about 5,000 to 200,000. The Tg of the polyesters for use in the present invention is generally 50° C. or over, and preferably 90° C. or over.

Then the polyester base is heat-treated at a heat treatment temperature of generally 40° C. or over, but less than the Tg, and preferably at a heat treatment temperature of the Tg −20° C. or more, but less than the Tg, so that it will hardly have core set curl. The heat treatment may be carried out at a constant temperature in the above temperature range, or it may be carried out with cooling. The heat treatment time is generally 0.1 hours or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the base means that, when a base is wound on a core, on its second and further winding, the base follows unevenness of its cut edge of the first winding, deforming its flat film-shape. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

Further, in the present invention, to adhere the base to the constitutional layers of light-sensitive material, a surface treatment is preferably carried out. A surface activation treatment can be mentioned, which includes a chemical treatment, a mechanical treatment, a corona discharge treatment, a flame treatment, an ultraviolet treatment, a high-frequency-treatment, a glow discharge treatment, an active-plasma treatment, a laser treatment, a mixed-acid treatment, and an ozone oxidation treatment. Among the surface treatments, an ultraviolet irradiation treatment, a flame treatment, a corona treatment, and a grow treatment are preferable.

With respect to the undercoating technique, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, and gelatin, can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 μm) may be included as a matting agent.

Further, in the present invention, an antistatic agent is preferably used. As the antistatic agent, polymers, including carboxylic acids, carboxylates, and sulfonates; cationic polymers, and ionic surface-active compounds can be mentioned.

Most preferable antistatic agents are fine particles of at least one crystalline metal oxide selected from the group consisting of ZnO, $TiO_2$, $SnO_2$, $Al_2O_3$, $In_2O_3$, $SiO_2$, MgO, BaO, $MoO_3$, and $V_2O_5$, and having a specific volume resistance of $10^7$ Ω·cm or less, and more preferably $10^5$ Ω·cm or less and a particle size of 0.001 to 1.0 μm, or fine particles of their composite oxides (Sb, P, B, In, S, Si, C, etc.); as well as fine particles of the above metal oxides in the form of a sol, or fine particles of composite oxides of these. The content thereof in the light-sensitive material is preferably 5 to 500 mg/$m^2$, and particularly preferably 10 to 350 mg/$m^2$. The ratio of the amount of the electroconductive crystalline oxide or its composite oxide to the amount of the binder is preferably from 1/300 to 100/1, and more preferably from 1/100 to 100/5.

The light-sensitive material of the present invention preferably has slipperiness. Preferably the slipping-agent-containing layer is provided on both the side of the light-sensitive layer, and the side of the backing layer. Preferable slipperiness is 0.25 or less, but 0.01 or more, in terms of coefficient of dynamic friction. In this case, the value is obtained in the measurement wherein a sample is transferred at 60 cm/min against a stainless steel ball of a diameter 5 mm, at 25° C. and 60% RH. In this evaluation, if it is replaced with the light-sensitive surface as the partner material, the value will be almost on the same level.

Examples of the slipping agent that can be used in the present invention, include, for example, polyorganosiloxanes, higher fatty acid amides, higher fatty acid metal salts, and esters of higher fatty acids with higher alcohols; and polyorganosiloxanes that can be used include polydimethylsiloxane, polydiethylsiloxane, polystyrylmethylsiloxane, and polymethylphenylsiloxane. The layer to which the slipping agent is added is preferably the outermost layer of the light-sensitive emulsion layers, or the backing layer. In particular, polydimethylsiloxanes, and esters having a long-chain alkyl group are preferable.

The light-sensitive material of the present invention preferably have a matting agent. When a matting agent is used, the matting agent may be added to either the side of the light-sensitive emulsions or the side of the backing layer, and particularly preferably it is added to the outermost layer on the side of the light-sensitive emulsions. The matting agent may or may not be soluble in the processing solution, and preferably a matting agent soluble in the processing solution and a matting agent insoluble in the processing solution are used together. For example, polymethyl methacrylate, poly(methyl methacrylate/methacrylic acid=9/1 or 5/5 (molar ratio)), and polystyrene particles are preferably used. Preferably the particle diameter is 0.8 to 10 μm. The narrower the particle diameter distribution is, the more preferable it is. Preferably 90% or more of all the particles is within 0.9 to 1.1 times the average particle diameter. To enhance the matte feature, it is also preferable at the same time to add fine particles of 0.8 μm or below, and examples are polymethyl methacrylates (0.2 μm), poly (methyl methacrylate/methacrylic acid=9/1 (molar ratio)) (0.3 μm), polystyrene particles (0.25 μm), and colloidal silica (0.03 μm).

Film patrones (magazines) for use in the present invention are now described. The major material of the patrone to be used in the present invention may be metal or synthetic plastic.

Preferable plastic materials are polystyrenes, polyethylenes, polypropylenes, polyphenyl ethers, and the like. Further, the patrone for use in the present invention may contain various antistatic agents, and preferably, for example, carbon black, metal oxide particles; nonionic, anionic, cationic, and betaine-series surface-active agents, or polymers can be used. These antistatic patrones are described in JP-A-1-312537 and 1-312538. In particular, the resistance of the patrone at 25° C. and 25% RH is preferably $10^{12}$ Ω or less. Generally, plastic patrones are made of plastics with which carbon black or a pigment has been kneaded, to make the patrones screen light. The size of the patrone may be size 135, which is currently used, and, to make cameras small, it is effective to change the diameter of the 25 -mm cartridge of the current size 135, to 22 mm or less. Preferably the volume of the case of the patrone is 30 $cm^3$ or less, and more preferably 25 $cm^3$ or less. The weight of the plastic to be used for the patrone or the patrone case is preferably 5 to 15 g.

Further, the patrone for use in the present invention may be one in which a spool is rotated to deliver a film. Also the structure may be such that the forward end of film is housed in the patrone body, and by rotating a spool shaft in the film-delivering direction, the forward end of the film is delivered out from a port of the patrone. These patrones are disclosed in U.S. Pat. Nos. 4,834,306 and 5,226,613. A photographic film for use in the present invention may be a so-called fresh film that has not been subject to development yet, or it may be a photographic film that has already been subjected to development. Further, the fresh film and the developed photographic film may be encased in the same new patrone, or they may be encased in different patroness, respectively.

The light-sensitive material of the present invention is not limited in particular, with respect to the numbers and arrangement of the silver halide emulsion layers and the light-insensitive layers, and therefore any arrangement of the layers may be used.

The color-sensitive emulsion layer unit of the light-sensitive material of the present invention is preferably composed of two or more partial layer (sub-layer) having different sensitivities, with not less than 3 partial layers being particularly preferred.

When the color-sensitive emulsion layer unit is composed of not less than 3 partial layers having different sensitivities, the preferable percentage of a coating silver amount of each of the partial layers is from 15 to 45% for the high-sensitivity (fast) layer, from 20 to 50% for the medium-sensitivity (intermediate) layer, and from 20 to 50% for the low-sensitivity (slow) layer, provided that the total silver amount of the said color-sensitive emulsion layers is 100%. Preferably the coating silver amount of the high-sensitivity layer is less than that of the medium-sensitivity layer or the low-sensitivity layer.

When the color-sensitive emulsion layer unit is composed of more than one partial layer differing in speed, preferably the lower the sensitivity of a partial layer is, the higher the silver iodide content of the partial layer is. When each of the light-sensitive emulsion layer units is composed of three partial layers differing in speed, particularly preferably the silver iodide content of a light-sensitive partial layer of the highest sensitivity is lower than that of a light-sensitive partial layer of the lowest sensitivity, by a difference of from 1.0 mol % to 5 mol %.

Various light-insensitive layers, such as an interlayer, may be placed in the middle of the color-sensitive emulsion layer unit, and/or in upper layers of the unit, and/or under layers of the unit. The said light-insensitive layer may contain a coupler and/or a DIR compound, as described in, for example, JP-A-61-43748, JP-A-59-113438, JP-A-59-113440, JP-A-61-20037, JP-A-61-20038, and U.S. Pat. No. 5,378,590, and also it may contain a color mixing-preventing agent, as usually used.

As mentioned above, various layer constructions and layer arrangements are available in accordance with the purpose of the light-sensitive material.

The amount of silver to be coated in the light-sensitive material of the present invention is preferably 6.0 $g/m^2$ or less, more preferably 5.0 $g/m^2$ or less, and most preferably 4.5 $g/m^2$ or less.

The color reversal photographic light-sensitive material of the present invention is excellent in skin tone reproduction, and it further exhibits preferable chroma with respect to skin colors with different tints. That is, the color reversal photographic light-sensitive material of the present invention has the capability of simultaneously reproducing a "fair skin tone" image of high relative chroma, with respect to usual "fair skin tone," and a "red-tint skin tone" image of low relative chroma, with respect to red-tint skin tone, as described herein.

Further, the color reversal photographic light-sensitive material of the present invention is excellent in gray and skin tone reproduction.

The color reversal photographic light-sensitive material of the present invention exhibits an excellent effect wherein the light-senstive material has an ability of forming a skin color image having a minimum change in hue of the skin color, ranging from low lightness to high lightness.

The present invention will now be described in more detail with reference to the following examples, but the invention is not limited to the examples.

EXAMPLES

Example 1

(Preparation of Sample 101)

Layers having the below-shown compositions were formed on a cellulose triacetate film support, having a thickness of 127 μm, that had been provided an undercoat, to prepare a multi-layer color light-sensitive material, which was named Sample 101. Each figure represents the added amount per square meter. In passing, it should be noted that the effect of the added compounds is not limited to the described use.

| | | |
|---|---|---|
| First Layer (Halation-preventing layer) | | |
| Black colloidal silver | | 0.30 g |
| Gelatin | | 2.30 g |
| Ultraviolet ray absorbent U-1 | | 0.10 g |
| Ultraviolet ray absorbent U-3 | | 0.04 g |
| Ultraviolet ray absorbent U-4 | | 0.10 g |
| High-boiling organic solvent Oil-1 | | 0.10 g |
| Coupler C-9 | | 0.12 mg |
| Second Layer (Intermediate layer) | | |
| Gelatin | | 0.38 g |
| Compound Cpd-A | | 5.0 mg |
| Compound Cpd-H | | 4.4 mg |
| Ultraviolet ray absorbent U-2 | | 3.0 mg |
| High-boiling organic solvent Oil-3 | | 0.10 g |
| Dye D-4 | | 10.0 mg |
| Third Layer (Intermediate layer) | | |
| Yellow colloidal silver | silver | 0.007 g |
| Gelatin | | 0.40 g |
| Fourth Layer (Low-sensitivity red-sensitive emulsion layer) | | |

-continued

| | | |
|---|---|---|
| Emulsion | silver | 0.62 g |
| Gelatin | | 0.63 g |
| Coupler C-1 | | 0.04 g |
| Coupler C-2 | | 0.09 g |
| Compound Cpd-A | | 5.0 mg |
| High-boiling organic solvent Oil-2 | | 0.10 g |
| Fifth Layer (Medium-sensitivity red-sensitive emulsion layer) | | |
| Emulsion | silver | 0.42 g |
| Gelatin | | 0.65 g |
| Coupler C-1 | | 0.05 g |
| Coupler C-2 | | 0.11 g |
| High-boiling organic solvent Oil-2 | | 0.10 g |
| Sixth Layer (High-sensitivity red-sensitive emulsion layer) | | |
| Emulsion | silver | 0.50 g |
| Gelatin | | 1.70 g |
| Coupler C-3 | | 0.70 g |
| Additive P-1 | | 0.20 g |
| High-boiling organic solvent Oil-2 | | 0.04 g |
| Seventh Layer (Intermediate layer) | | |
| Gelatin | | 0.60 g |
| Additive M-1 | | 0.30 g |
| Compound Cpd-A | | 0.05 g |
| Compound Cpd-D | | 0.04 g |
| Compound Cpd-I | | 0.04 mg |
| High-boiling organic solvent Oil-3 | | 0.10 g |
| Eighth Layer (Intermediate layer) | | |
| Yellow colloidal silver | silver | 0.04 g |
| Gelatin | | 1.20 g |
| Compound Cpd-A | | 0.10 g |
| High-boiling organic solvent Oil-3 | | 0.20 g |
| Ninth Layer (Low-sensitivity green-sensitive emulsion layer) | | |
| Emulsion | silver | 0.85 g |
| Gelatin | | 1.20 g |
| Coupler C-7 | | 0.07 g |
| Coupler C-8 | | 0.17 g |
| Compound Cpd-B | | 0.30 mg |
| Compound Cpd-C | | 2.00 mg |
| High-boiling organic solvent Oil-2 | | 0.10 g |
| Tenth Layer (Medium-sensitivity green-sensitive emulsion layer) | | |
| Emulsion | silver | 0.53 g |
| Core/shell-type fine grain Silver bromide emulsion, whose inner part was fogged (av. grain diameter: 0.11 μm) | silver | 0.08 g |
| Gelatin | | 0.50 g |
| Coupler C-4 | | 0.26 g |
| Compound Cpd-B | | 0.03 g |
| High-boiling organic solvent Oil-2 | | 0.01 g |
| Eleventh Layer (High-sensitivity green-sensitive emulsion layer) | | |
| Emulsion | silver | 0.44 g |
| Gelatin | | 0.65 g |
| Coupler C-4 | | 0.35 g |
| Compound Cpd-B | | 0.08 g |
| High-boiling organic solvent Oil-2 | | 0.02 g |
| Twelfth Layer (Intermediate layer) | | |
| Gelatin | | 0.30 g |
| Compound Cpd-A | | 0.03 g |
| High-boiling organic solvent Oil-3 | | 0.06 g |
| Thirteenth Layer (Yellow filter layer) | | |
| Yellow colloidal silver | silver | 0.08 g |
| Gelatin | | 0.50 g |
| Compound Cpd-A | | 0.04 g |
| Compound Cpd-G | | 0.02 g |

-continued

| | | |
|---|---|---|
| High-boiling organic solvent Oil-3 | | 0.10 g |
| Fourteenth Layer (Low-sensitivity blue-sensitive emulsion layer) | | |
| Emulsion | silver | 0.38 g |
| Gelatin | | 0.60 g |
| Coupler C-5 | | 0.26 g |
| Coupler C-6 | | 5.00 g |
| Coupler C-10 | | 0.03 g |
| Fifteenth Layer (Medium-sensitivity blue-sensitive emulsion layer) | | |
| Emulsion | silver | 0.20 g |
| Gelatin | | 0.80 g |
| Coupler C-5 | | 0.35 g |
| Coupler C-6 | | 5.00 g |
| Coupler C-10 | | 0.030 g |
| Sixteenth Layer (High-sensitivity blue-sensitive emulsion layer) | | |
| Emulsion | silver | 0.44 g |
| Gelatin | | 2.60 g |
| Coupler C-6 | | 0.10 g |
| Coupler C-10 | | 1.00 g |
| Compound Cpd-E | | 0.10 g |
| High-boiling organic solvent Oil-2 | | 0.40 g |
| Seventeenth Layer (First protective layer) | | |
| Gelatin | | 1.00 g |
| Ultraviolet ray absorber U-1 | | 0.10 g |
| Ultraviolet ray absorber U-2 | | 0.03 g |
| Ultraviolet ray absorber U-5 | | 0.20 g |
| Compound Cpd-A | | 0.09 g |
| Compound Cpd-F | | 0.40 g |
| Dye D-1 | | 0.01 g |
| Dye D-2 | | 0.05 g |
| Dye D-3 | | 0.01 g |
| Dye D-5 | | 0.01 g |
| High-boiling organic solvent Oil-3 | | 0.30 g |
| Eighteenth Layer (Second protective layer) | | |
| Yellow colloidal silver | silver | 0.10 mg |
| Silver iodobromide emulsion of fine grains (av. grain diameter: 0.06 μm, AgI content: 1 mol %) | silver | 0.10 g |
| Gelatin | | 0.70 g |
| Ultraviolet ray absorber U-1 | | 0.06 g |
| Ultraviolet ray absorber U-2 | | 0.02 g |
| Ultraviolet ray absorber U-5 | | 0.12 g |
| High-boiling point organic solvent Oil-1 | | 0.07 g |
| Nineteenth Layer (Third protective layer) | | |
| Gelatin | | 1.40 g |
| Poly(methyl methacrylate) (average grain diameter 1.5 μm) | | 5.00 g |
| Copolymer of methyl methacrylate and methacrylic acid (6:4) grain diameter 1.5 μm) | | 0.10 g |
| Silicon oil SO-1 | | 0.030 g |
| Surface active agent W-2 | | 0.030 g |

Further, to all emulsion layers, in addition to the above-described components, additives F-1 to F-11 were added. Further, to each layer, in addition to the above-described components, a gelatin hardener H-1 and surface active agents W-1, W-3, W-4, W-5, and W-6 for coating and emulsifying, were added.

Further, as antifungal and antibacterial agents, phenol, 1,2-benzisothiazoline-3-one, 2-phenoxyethanol, phenetylalcohol, and p-hydroxybenzoic acid butyl ester were added.

Light-sensitive emulsions that were used in Sample 101 are illustrated in Tables 5.

TABLE 5

Light-sensitive emulsions used in Sample 101

| Used amount | Emulsion | Coated amount of silver ($g/m^2$) | Average aspect ratio of all grains | Diameter of projected area (circle-equivalent) Average diameter (μm) | Diameter of projected area (circle-equivalent) Deviation coefficient (%) | AgI content Average (mol %) | AgI content Deviation coefficient (%) |
|---|---|---|---|---|---|---|---|
| Low-sensitivity | A | 0.28 | 1.0 | 0.24 | 9 | 3.6 | 55 |
| red-sensitive | B | 0.15 | 1.0 | 0.25 | 10 | 3.63 | 50 |
| emulsion layer | C | 0.19 | 1.0 | 0.25 | 7 | 3.3 | 20 |
| Medium-sensitivity red-sensitive emulsion layer | D | 0.42 | 1.0 | 0.43 | 9 | 3.0 | 50 |
| High-sensitivity red-sensitive emulsion layer | E | 0.50 | 4.1 | 0.78 | 24 | 1.6 | 20 |
| Low-sensitivity | F | 0.23 | 1.0 | 0.18 | 13 | 4.0 | 15 |
| green-sensitive | G | 0.29 | 1.0 | 0.24 | 10 | 4.0 | 50 |
| emulsion layer | H | 0.33 | 1.0 | 0.40 | 8 | 3.9 | 20 |
| Medium-sensitivity green-sensitive emulsion layer | I | 0.53 | 1.0 | 0.52 | 9 | 3.2 | 20 |
| High-sensitivity green-sensitive emulsion layer | K | 0.44 | 4.5 | 1.04 | 26 | 2.8 | 65 |
| Low-sensitivity | L | 0.11 | 1.0 | 0.51 | 9 | 4.7 | 15 |
| blue-sensitive | M | 0.10 | 1.0 | 0.52 | 9 | 4.7 | 20 |
| emulsion layer | N | 0.17 | 1.0 | 0.52 | 9 | 4.7 | 35 |
| Medium-sensitivity | O | 0.1 | 4.1 | 0.64 | 20 | 2.0 | 35 |
| blue-sensitive emulsion layer | P | 0.1 | 4.1 | 0.75 | 17 | 1.0 | 30 |
| High-sensitivity | Q | 0.20 | 4 | 0.80 | 25 | 1.0 | 65 |
| blue-sensitive emulsion layer | R | 0.24 | 5 | 1.20 | 25 | 0.8 | 20 |

| Used amount | Emulsion | Feature of grain | Ratio of (111) plane on surface | Kind of sensitizing dye added Kind | Kind | Kind |
|---|---|---|---|---|---|---|
| Low-sensitivity | A | Tetradecahedral grain | 45 | S-1 | S-13 | — |
| red-sensitive | B | Tetradecahedral grain | 35 | S-2 | S-3 | — |
| emulsion layer | C | Cubic grain | 0 | S-2 | S-3 | |
| Medium-sensitivity red-sensitive emulsion layer | D | Tetradecahedral grain | 50 | S-1 | S-3 | — |
| High-sensitivity red-sensitive emulsion layer | E | Tabular grain | 90 | S-1 | S-2 | S-3 |
| Low-sensitivity | F | Cubic grain | 2 | S-4 | S-5 | — |
| green-sensitive | G | Cubic grain | 1 | S-4 | S-5 | — |
| emulsion layer | H | Cubic grain | 0 | S-4 | S-5 | — |
| Medium-sensitivity green-sensitive emulsion layer | I | Cubic grain | 0 | S-4 | S-9 | S-10 |
| High-sensitivity green-sensitive emulsion layer | K | Tabular grain | 98 | S-8 | S-9 | S-14 |
| Low-sensitivity | L | Tetradecahedral grain | 55 | S-11 | S-12 | — |
| blue-sensitive | M | Tetradecahedral grain | 50 | S-11 | S-12 | — |
| emulsion layer | N | Tetradecahedral grain | 45 | S-11 | S-12 | — |
| Medium-sensitivity | O | Tabular grain | 98 | S-11 | S-12 | — |
| blue-sensitive emulsion layer | P | Tabular grain | 99 | S-11 | S-12 | — |
| High-sensitivity | Q | Tabular grain | 99 | S-11 | S-12 | — |
| blue-sensitive emulsion layer | R | Tabular grain | 99 | S-11 | S-12 | — |

Note 1) Each of emulsions described above was a core/shell-type emulsion having a high-iodide phase in the emulsion grain, and each emulsion was subjected to gold/sulfur/selenium sensitization or gold/sulfur sensitization.
Note 2) To each emulsion described above, compounds F-5, F-7, F-8, F-9, F-10, and F-11 were added appropriately.
Note 3) Ratio of (111) plane on surface was determined by a method with Kubelka-Munk.
Note 4) Emulsion C was a negative-type emulsion capable of forming a latent image in the grain.

TABLE 5-continued
| Light-sensitive emulsions used in Sample 101 |
|---|
| C-1 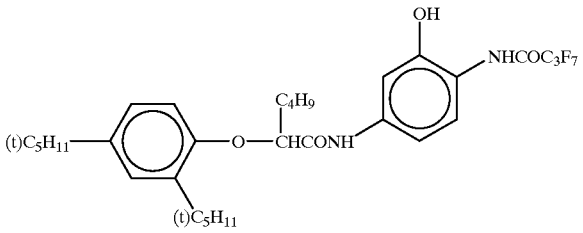 |
| C-2 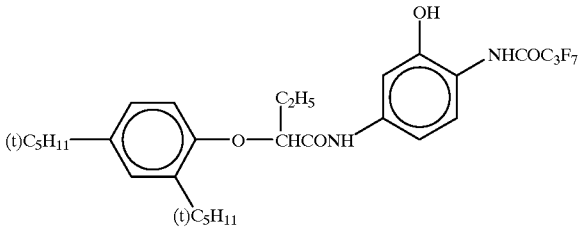 |
| C-3 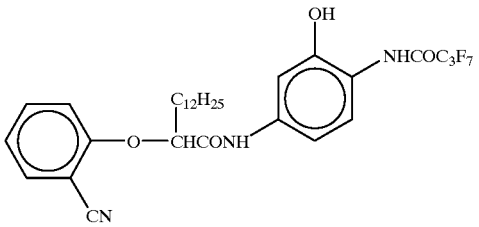 |
| C-4 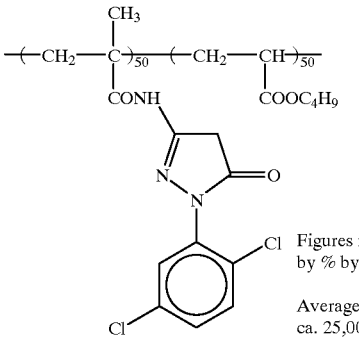 Figures indicates amounts by % by weight<br>Average molecular weight: ca. 25,000 |
| C-5 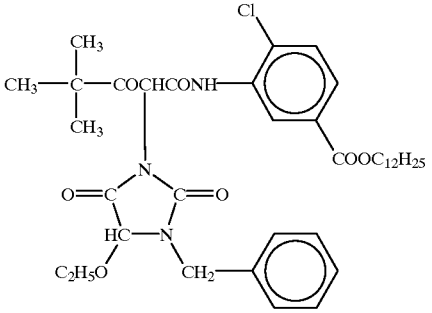 |
| C-6 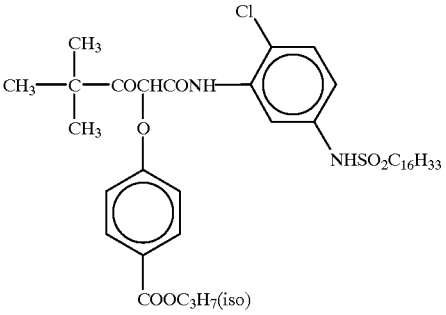 |

TABLE 5-continued
| Light-sensitive emulsions used in Sample 101 | |
|---|---|
| C-7 | 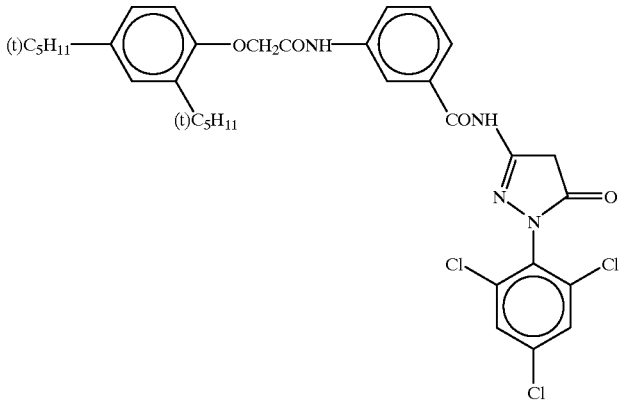 |
| C-8 | 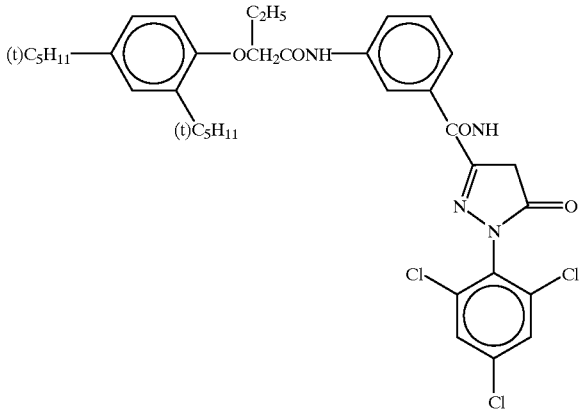 |
| C-9 | 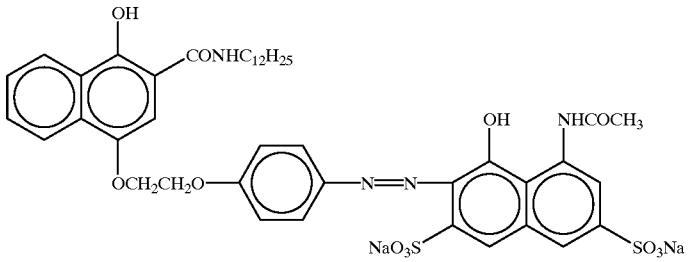 |
| C-10 | 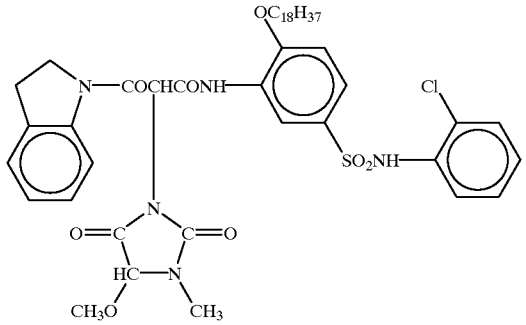 |
| Oil-1 | Dibutyl phthalate |
| Oil-2 | Tricresyl phosphate |

TABLE 5-continued
Light-sensitive emulsions used in Sample 101
Oil-3
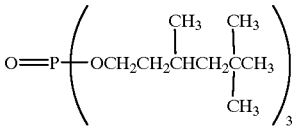
Cpd-A
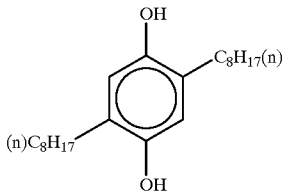
Cpd-B
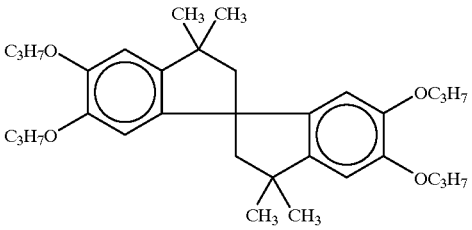
Cpd-C
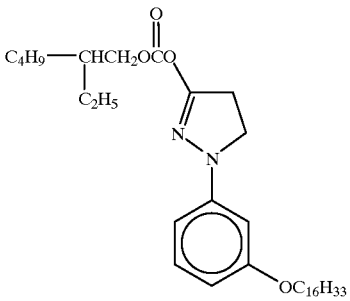
Cpd-D
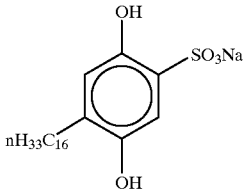
Cpd-E
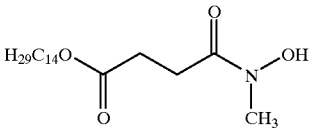
Cpd-F
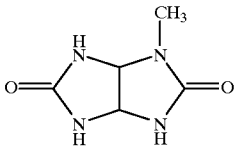
Cpd-G
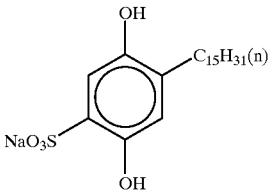
Cpd-H
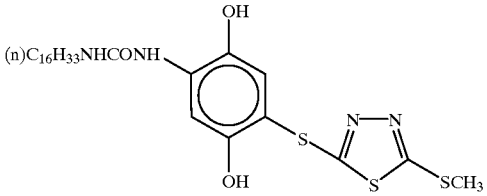
Cpd-I
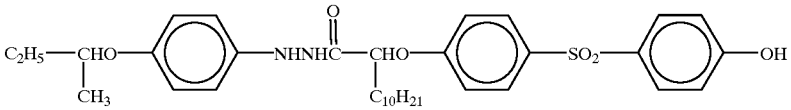
U-1
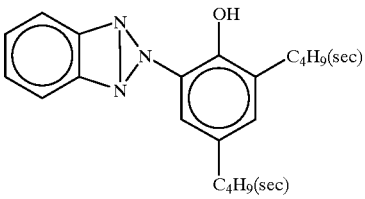
U-2
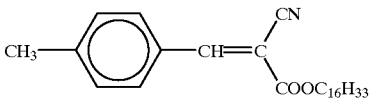

TABLE 5-continued
Light-sensitive emulsions used in Sample 101
U-3
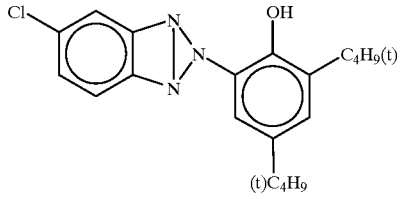
U-4
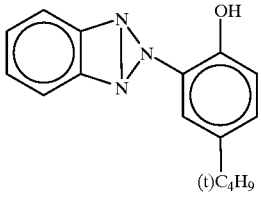
U-5
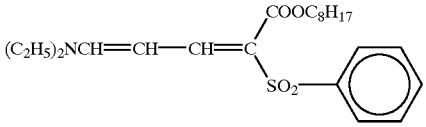
S-1
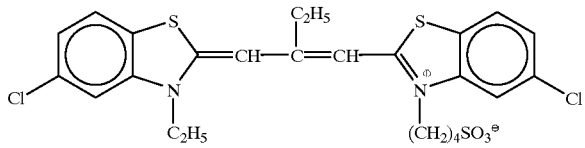
S-2
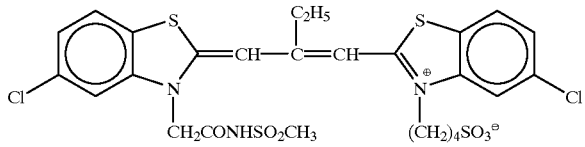
S-3
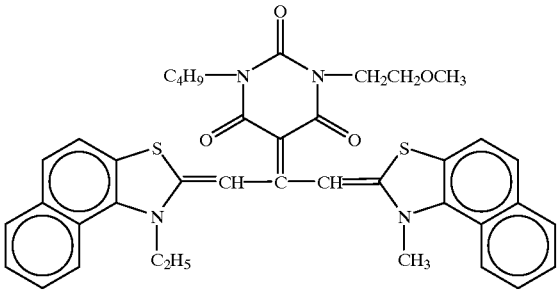
S-4
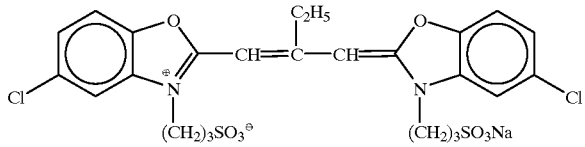
S-5
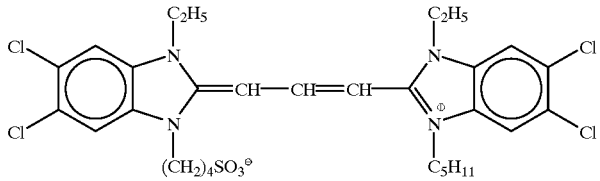
S-6
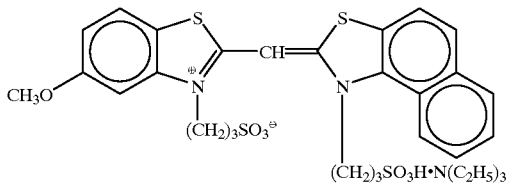

TABLE 5-continued
| Light-sensitive emulsions used in Sample 101 |
|---|
| S-7 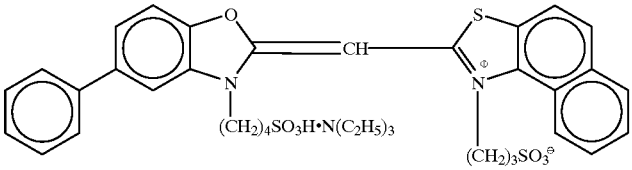 |
| S-8 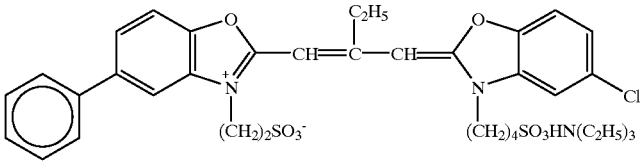 |
| S-9 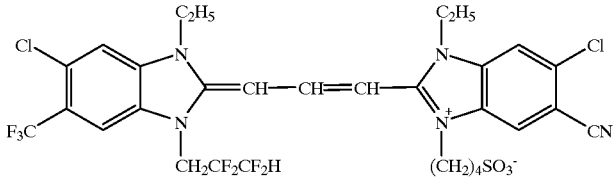 |
| S-10 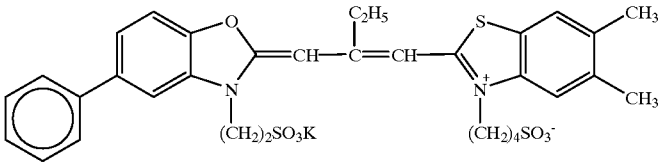 |
| S-11 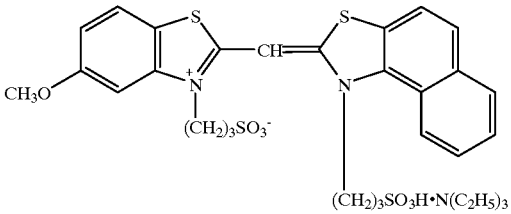 |
| S-12 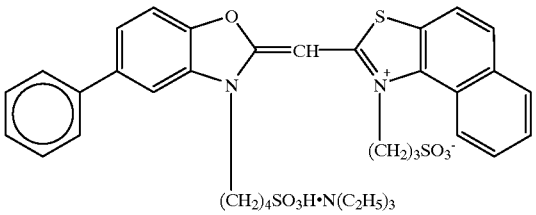 |
| S-13 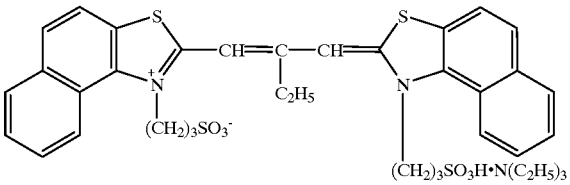 |

TABLE 5-continued
| Light-sensitive emulsions used in Sample 101 | |
|---|---|
| S-14 | 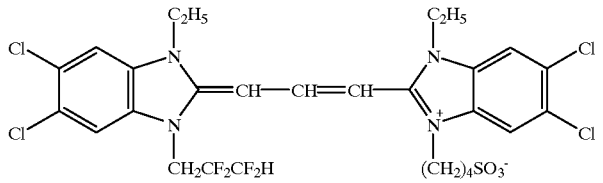 |
| D-1 | 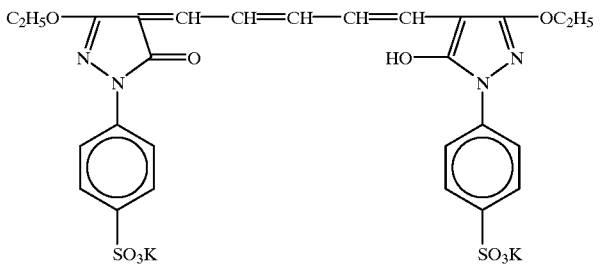 |
| D-2 | 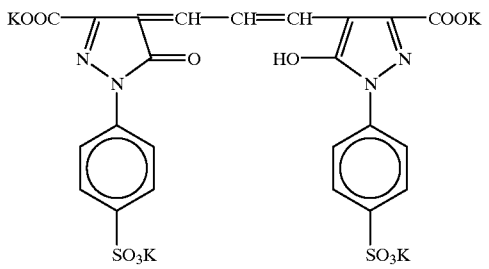 |
| D-3 | 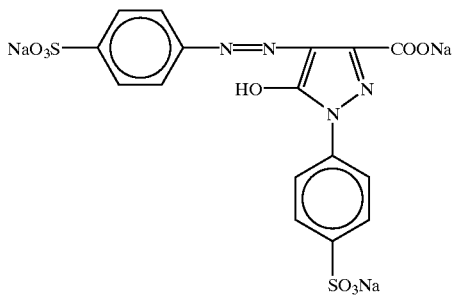 |
| D-4 | 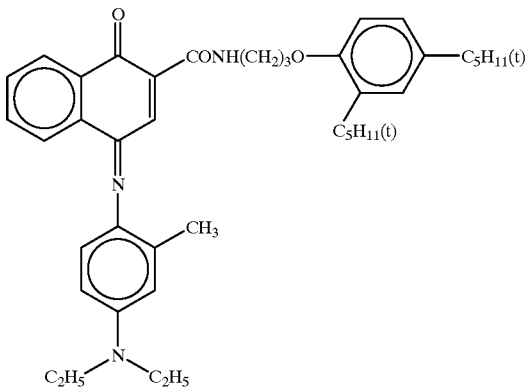 |

TABLE 5-continued
| Light-sensitive emulsions used in Sample 101 | |
|---|---|
| D-5 | 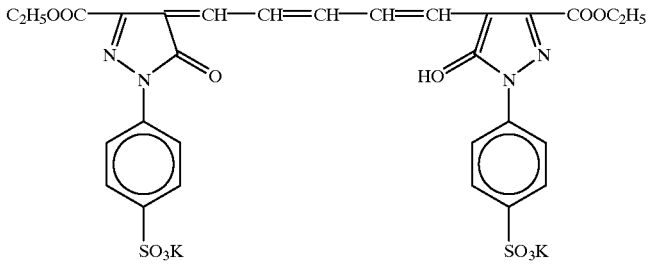 |
| D-6 | 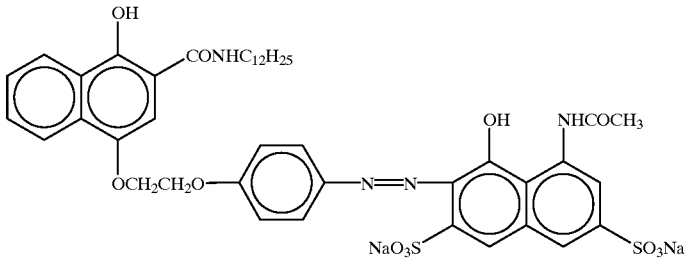 |
| E-1 | 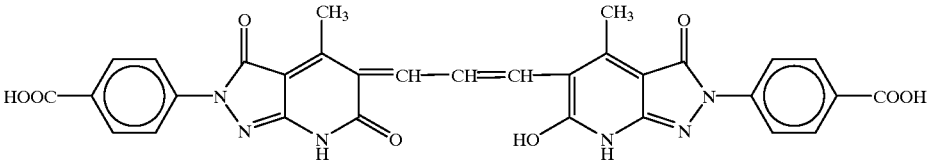 |
| E-2 | 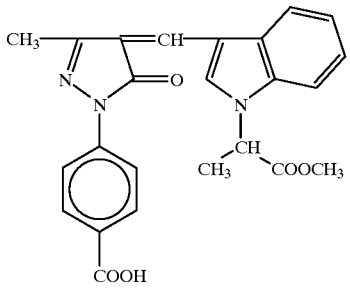 |
| E-3 | 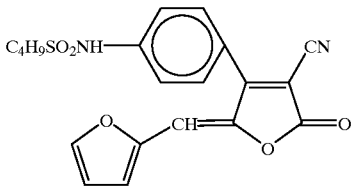 |
| H-1 | 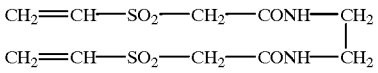 |
| W-1 | $H_{25}C_{12}$—O—$SO_3H.Na$ |
| W-2 | 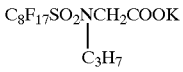 |
| W-3 | 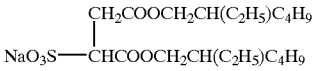 |
| W-4 | 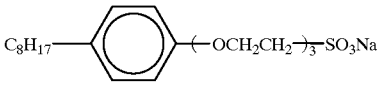 |

TABLE 5-continued
| Light-sensitive emulsions used in Sample 101 | | | |
|---|---|---|---|
| W-5 | 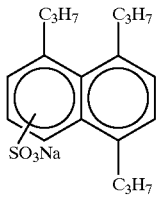 | W-6 | 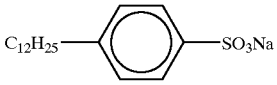 |
| P-1 | 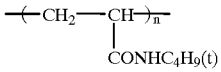 | M-1 | 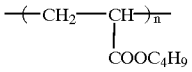 |
| SO-1 | 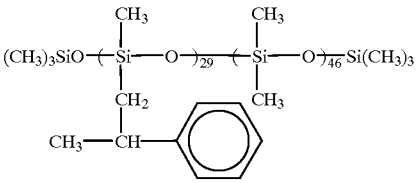 | F-1 | 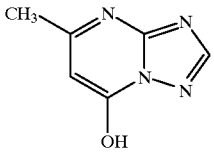 |
| F-2 | 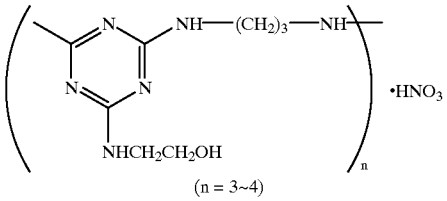 | F-3 | 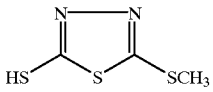 |
| F-4 | 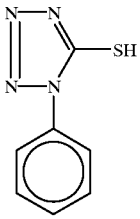 | F-5 | 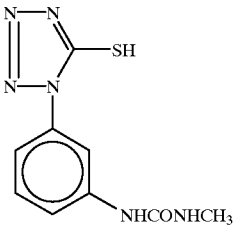 |
| F-6 | 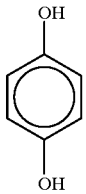 | F-7 | 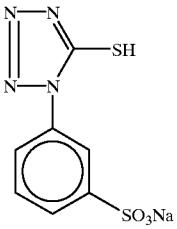 |
| F-8 | 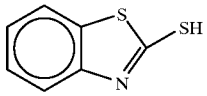 | F-9 | 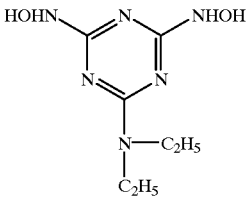 |

TABLE 5-continued

| Light-sensitive emulsions used in Sample 101 | | | |
|---|---|---|---|
| F-10 | 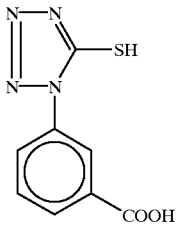 | F-11 | 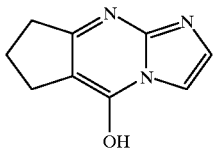 |

(Evaluation of Samples)

The spectral distribution under the standard illumination of each of the colors (relative spectral luminance) was calculated from the spectral reflectances of "gray," "(fair) skin tone," and "red-tint skin tone," as shown in the above-mentioned Tables 1 and 2, multiplied by the spectral distribution of an ISO sensitometric daylight source ($D_{55}$)

The above spectral distribution was generated by a spectrosensitometer device that is able to produce any of the spectral distributions by using an intensity modulating-type mask formed by arranging liquid crystal panels in the stripe form, and further by electrically controlling the transmittance of each of the liquid crystal segments.

The spectrosensitometer device that is able to generate the above-described spectral distribution was manufactured with reference to the reports presented by Enomoto et al. in the Annual Meeting of SPSTJ '90.

As illustrated in FIG. 1, a xenon arc lamp having a high luminance was used as a light source, and in addition, a cylindrical lens was used in the optical system, thereby obtaining a long slit light extended to the grating direction of a diffraction grating. A light separated by a transmission-type diffraction grating acts as a spectral face having a wavelength region of from 400 nm to 700 nm at the dispersion face. Onto this spectral face, were placed liquid crystal panels composed of 60 segments, in which 1 segment is 5 nm, and transmittance was controlled at intervals of 5 nm, thereby obtaining an objective spectral distribution.

A color-mixed slit light was formed on the surface of exposure to light, and the exposure to light was performed by scanning the sample 101 of the present invention and commercially available color reversal film articles, designated Articles A to H, on each of which an optical wedge was placed, at an orthogonal direction to the slit light.

These samples thus exposed to light, each having a spectral distribution of "gray," "skin tone", and "red-tint skin tone," were subjected to the processing described below (processing A), to obtain an image. Densitometry of the thus-obtained image was carried out, respectively. The measurement of the "skin tone" and the "red-tint skin tone," each of which was reproduced by these samples, was carried out under the observational condition based on an isochromatic test in which twice sight (2-degree calorimetric observation) was adopted at the 1931 CIE (Commission Internationale de I'Eclairage) conference.

Further, to calculate the CIE Lab values, the 1976 CIE (L*, a*, b*) isometric perceptive color space calculations were used. For a more detailed explanation of the above-mentioned calculations, reference was made to, for example, *New-Edition Color Science Handbook*, edited by the publication party of Tokyo University (1980), Chapter 4.

When the C* value of the "gray" image was not less than 0.5 at L*=40, color correction was made by exposing the sample to a light of "gray," "skin tone," or "red-tint skin tone," through a commercially available color compensating filter.

Evaluation of point-gamma was performed in accordance with the above-mentioned test conditions.

Further, the above-described samples were each cut into patches of size 4×5 inches, and pictures of a white (Caucasian) man and woman, and a Japanese man and woman (the yellow race), as models, were taken on the patch samples, followed by the above-mentioned processing of development. Photographic properties of each processed sample were evaluated by visual sensitive evaluation. At this time, a picture of a Mansell N=5 color standard was simultaneously taken. When the C* value was not less than 0.5, a commercially available color compensating filter was inserted for each sample, to correct so that the C* value was not more than 0.5, in the same manner as the evaluation of a spectrosensitometer. The evaluation was performed by ten (10) testers. The "skin tone reproduction", the "chroma of the skin tone", and the "appearance of red tint (deviation of red tint arisen) in the skin tone" ware evaluated in accordance with the following three evaluation grades.

| Marks | Evaluation |
|---|---|
| 2 | Very good |
| 1 | Normal |
| 0 | Poor |

The evaluation values were represented by average values of the marks given by the ten (10) testers.

The above-mentioned evaluation results are shown in Table 6 below.

TABLE 6

| | Sample 101 | Article A | Article B | Article C | Article D | Article E | Article F | Article G | Article H |
|---|---|---|---|---|---|---|---|---|---|
| C* value of "gray" image in CIE Lab color specification system at L* = 40 | 0.15 | 0.20 | 0.18 | 0.21 | 0.19 | 0.17 | 0.20 | 0.15 | 0.16 |
| C* value of "skin color" image in CIE Lab color specification system at L* = 40 to 70 | 24~30 | 26~32 | 24~31 | 30~38 | 26~33 | 23~28 | 26~28 | 23~28 | 19~22 |

TABLE 6-continued

| | Sample 101 | Article A | Article B | Article C | Article D | Article E | Article F | Article G | Article H |
|---|---|---|---|---|---|---|---|---|---|
| C* value of "red-tint skin color" image in CIE Lab color specification system at L* = 20 | 27 | 29 | 31 | 34 | 35 | 32 | 35 | 32 | 26 |
| C* value of "red-tint skin color" image in CIE Lab color specification system at L* = 40 | 39 | 44 | 43 | 50 | 43 | 37 | 43 | 37 | 33 |
| Point-gamma value of R at color density of 2.0 | 2.02 | 2.10 | 2.35 | 2.56 | 2.28 | 2.51 | 2.68 | 2.12 | 2.32 |
| Point-gamma value of G at color density of 2.0 | 2.05 | 2.02 | 2.34 | 2.60 | 2.53 | 2.72 | 2.72 | 2.05 | 2.45 |
| Point-gamma value of B at color density of 2.0 | 1.97 | 2.11 | 2.41 | 2.58 | 2.19 | 2.43 | 2.71 | 2.31 | 2.51 |
| Point-gamma value of R at color density of 1.0 | 1.42 | 1.52 | 1.58 | 1.51 | 1.50 | 1.51 | 1.82 | 1.45 | 1.38 |
| Point-gamma value of G at color density of 1.0 | 1.43 | 1.53 | 1.59 | 1.53 | 1.51 | 1.52 | 1.81 | 1.48 | 1.37 |
| Point-gamma value of B at color density of 1.0 | 1.41 | 1.54 | 1.57 | 1.54 | 1.52 | 1.51 | 1.83 | 1.47 | 1.36 |
| Point-gamma value of R at color density of 0.5 | 0.95 | 1.22 | 1.21 | 1.31 | 1.05 | 0.98 | 1.00 | 0.98 | 1.12 |
| Point-gamma value of G at color density of 0.5 | 0.95 | 1.24 | 1.25 | 1.28 | 0.99 | 0.95 | 1.02 | 0.92 | 1.11 |
| Point-gamma value of B at color density of 0.5 | 0.95 | 1.23 | 1.23 | 1.32 | 0.98 | 0.92 | 0.98 | 1.01 | 1.06 |
| C* maximum value of "gray" image in CIE Lab color specification system at L* = 10 to 80 | 8.7 | 10.8 | 13.5 | 9.8 | 12.1 | 13.8 | 14.9 | 14.7 | 14.2 |
| Tone reproduction of skin color of models | 1.9 | 0.7 | 0.6 | 0.3 | 1.4 | 1.5 | 1.4 | 1.4 | 1.7 |
| Chroma of skin color of models | 1.9 | 1.8 | 1.6 | 1.8 | 1.5 | 0.8 | 1.3 | 0.8 | 0.2 |
| Deviation of red-tint of skin color of models | 1.9 | 1.2 | 1.3 | 0.3 | 0.7 | 1.3 | 1.2 | 1.3 | 1.8 |

As is apparent from the results shown in Table 6, with respect to the photographic light-sensitive materials, except for Sample 101 of the present invention, the C* values of the "fair skin tone" and the "red-tint skin tone" both reproduced, in the CIE Lab color specification system, did not fall within the range defined by the present invention. For instance, with respect to Article H, the C* value of the "red-tint skin tone" was within the range defined by the present invention, but the C* value of the "fair skin tone" was low. In another instance, with respect to Article B, the C* value of the "fair skin tone" was within the range defined by the present invention, but the C* value of the "red-tint skin tone" was greater than the range defined by the present invention. Further, it is found that their point-gamma at the density of 0.5 was high, and their tone reproduction was inferior. Consequently, it is apparent that only the sample of the present invention exhibits preferable chroma and reproduction of the skin tone.

From the results in the visual evaluation, it is also apparent that Sample 101 was excellent in all of "skin tone reproduction", "chroma of skin tone", and "appearance of red-tint in the skin tone", and therefore a photographic light-sensitive material of the present invention exhibits excellent skin color reproduction.

(Processig A)

| Processing step | Time | Temperature | Tank volume | Replenisher amount |
|---|---|---|---|---|
| 1st development | 6 min | 38° C. | 12 liters | 2,200 ml/m$^2$ |
| 1st water-washing | 2 min | 38° C. | 4 liters | 7,500 ml/m$^2$ |
| Reversal | 2 min | 38° C. | 4 liters | 1,100 ml/m$^2$ |
| Color development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 2 liters | 220 ml/m$^2$ |
| Fixing | 4 min | 38° C. | 8 liters | 1,100 ml/m$^2$ |
| 2nd water-washing | 4 min | 38° C. | 8 liters | 7,500 ml/m$^2$ |
| Final-rinsing | 1 min | 25° C. | 2 liters | 1,100 ml/m$^2$ |

Compositions of each processing solution used were as follows:

| | Tank solution | Replenisher |
|---|---|---|
| First developer | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |
| Reversal solution (Both tank solution and replenisher) | | |
| Pentasodium nitrilo-N,N,N-trimethylenephosphonate | 3.0 g | |
| Stannous chloride dihydrate | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |
| (pH was adjusted by using acetic acid or sodium hydroxide) | | |

| | Tank solution | Replenisher |
|---|---|---|
| Color developer | | |
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamido- | 11 g | 11 g |

-continued

| | | |
|---|---|---|
| ethyl)-3-methyl-4-amino aniline.3/2 sulfate · mono hydrate | | |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using sulfuric acid or potassium hydroxide) | | |
| Pre-bleaching solution | | |
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde.sodium bisulfite adduct | 30 g | 35 g |
| Water to make | 1,000 ml | 1,000 ml |
| pH | 6.30 | 6.10 |
| (pH was adjusted by using acetic acid or sodium hydroxide) | | |
| Bleaching solution | | |
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using nitric acid or sodium hydroxide) | | |
| Fixing solution (Both tank solution and replenisher) | | |
| Ammonium thiosulfate | 80 g | |
| Sodium sulfite | 5.0 g | |
| Sodium bisulfite | 5.0 g | |
| Water to make | 1,000 ml | |
| pH | 6.60 | |
| (pH was adjusted by using acetic acid or aqueous ammonia) | | |
| Stabilizing solution | | |
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

Example 2

(Preparation of Sample 201)

Sample 201 was prepared in the same manner as Sample 101 in Example 1, except that a gelatin intermediate layer (gelatin coating amount 0.30 g) was provided between the thirteenth layer (yellow filter layer) and the fourteenth layer (low-sensitivity blur-sensitive emulsion layer).

(Preparation of Sample 202)

Sample 202 was prepared in the same manner as Sample 201, except that protective layers were changed as shown below.

| | | |
|---|---|---|
| Eighteenth Layer (First protective layer) | | |
| Gelatin | | 1.30 g |
| Ultraviolet ray absorber U-1 | | 0.16 g |
| Ultraviolet ray absorber U-2 | | 0.05 g |
| Ultraviolet ray absorber U-5 | | 0.32 g |
| Compound Cpd-A | | 0.09 g |
| Compound Cpd-F | | 0.40 g |

-continued

| | | |
|---|---|---|
| Dye D-1 | | 0.01 g |
| Dye D-2 | | 0.05 g |
| Dye D-3 | | 0.01 g |
| Dye D-5 | | 0.01 g |
| High-boiling organic solvent Oil-2 | | 0.37 g |
| Nineteenth Layer (Second protective layer) | | |
| Yellow colloidal silver | silver | 0.10 mg |
| Silver iodobromide emulsion of fine grains (av. grain diameter: 0.06 μm, AgI content: 1 mol %) | silver | 0.10 g |
| Gelatin | | 1.80 g |
| Poly(methyl methacrylate) (average grain diameter 1.5 μm) | | 5.00 g |
| Copolymer of methyl methacrylate and methacrylic acid (6:4) (average grain diameter 1.5 μm) | | 0.10 g |
| Silicon oil SO-1 | | 0.030 g |
| Surface active agent W-2 | | 0.030 g |

(Preparation of Sample 203)

Preparation of a Dispersion of Organic Solid Dispersed Dye

Dye E-1 was dispersed in accordance with the following method. To 1430 g of a wet cake of the dye containing methanol in an amount of 30%, water and 200 g of Pluronic F88, trade name, manufactured by BASF Co. (ethylene oxide/propylene oxide block copolymer), were added, with stirring, to prepare a slurry having the dye content of 6%. Then, 1700 ml of zirconia beads having an average diameter of 0.5 mm was filled into ULTRAVISCOMILL (UVM-2), manufactured by IMEX Co., Ltd., through which the above-obtained slurry was passed and ground at the round speed of about 10 m/sec and a discharge rate of 0.5 liters/min for 8 hrs. After the beads were removed from the slurry by filtration, the filtrate was added to water, in order to dilute the dye density to 3%, followed by heating at 90° C. for 10 hrs, for stabilization. The thus-obtained fine particles of the dye had an average particle diameter of 0.60 μm and a range of particle diameter distribution (standard deviation of particle diameter ×100/average particle diameter) of 18%.

In the similar manner, solid dispersions of Dye E-2 or E-3 were obtained, respectively. These dye fine particles had average diameters of 0.54 μm and 0.56 μm, respectively.

Sample 203 was prepared in the same manner as Sample 202, except that 0.10 g of the fine crystal solid dispersion of Dye E-1 was added in the first layer (halation preventing layer) of Sample 202, the twelfth layer (intermediate layer) of Sample 202 was removed, 0.03 g and 0.02 g of fine crystal solid dispersion of Dye E-2 and E-3 were added, respectively, to the thirteenth layer (yellow filter layer) of Sample 202, and the amount of yellow colloidal silver in the thirteenth layer (yellow filter layer) of Sample 202 was reduced to 0.02 g.

Sample 201 to 203 were evaluated in the same manner as in Example 1.

The evaluation results obtained are shown in Table 7. As same to Sample 101 in Example 1, similar favorable results were obtained in Sample 201 to 203.

TABLE 7

| | Article 201 | Article 202 | Article 203 |
|---|---|---|---|
| C* value of "gray" image in CIE Lab color specification system at L* = 40 | 0.13 | 0.12 | 0.16 |
| C* value of "skin color" image in CIE Lab color specification system at L* = 40 to 70 | 31~33 | 28~33 | 29~34 |

TABLE 7-continued

| | Article 201 | Article 202 | Article 203 |
|---|---|---|---|
| C* value of "red-tint skin color" image in CIE Lab color specification system at L* = 20 | 25 | 29 | 29 |
| C* value of "red-tint skin color" image in CIE Lab color specification system at L* = 40 | 35 | 37 | 38 |
| Point-gamma value of R at color density of 2.0 | 2.02 | 2.04 | 2.04 |
| Point-gamma value of G at color density of 2.0 | 2.05 | 2.02 | 2.10 |
| Point-gamma value of B at color density of 2.0 | 2.00 | 2.03 | 2.09 |
| Point-gamma value of R at color density of 1.0 | 1.48 | 1.51 | 1.54 |
| Point-gamma value of G at color density of 1.0 | 1.48 | 1.51 | 1.55 |
| Point-gamma value of B at color density of 1.0 | 1.49 | 1.52 | 1.53 |
| Point-gamma value of R at color density of 0.5 | 0.98 | 0.89 | 0.82 |
| Point-gamma value of G at color density of 0.5 | 0.97 | 0.90 | 0.83 |
| Point-gamma value of B at color density of 0.5 | 0.99 | 0.91 | 0.82 |
| C* maximum value of "gray" image in CIE Lab color specification system at L* = 10 to 80 | 4.8 | 8.9 | 7.8 |
| Tone reproduction of skin color of models | 2.0 | 1.9 | 1.9 |
| Chroma of skin color of models | 2.0 | 1.9 | 1.9 |
| Deviation of red-tint of skin color of models | 2.0 | 1.8 | 1.9 |

Example 3

On a cellulose triacetate film support, having a thickness of 95 μm, backing layers having the below composition were provided on one surface of the support, and on the other surface of the support, the same layers in Sample 101 in Example 1, or Samples 201 to 203 in Example 2 were provided, respectively, to prepare Samples 301 to 304.

Composition of Backing Layers

Each figure corresponding to each component, represents the coated amount in terms of g/m$^2$.

| | |
|---|---|
| First Layer | |
| Binder: acid-processed gelatin (isoelectric point 9.0) | 1.00 |
| Polymer latex: P-1 (av. particle diameter 0.1 μm) | 0.13 |
| Polymer latex: P-2 (av. particle diameter 0.2 μm) | 0.23 |
| Ultraviolet ray absorbent: U-1 | 0.03 |
| Ultraviolet ray absorbent: U-3 | 0.01 |
| Ultraviolet ray absorbent: U-4 | 0.02 |
| High-boiling organic solvent: Oil-1 | 0.03 |
| Surface active agent: W-3 | 0.01 |
| Surface active agent: W-6 | $3.0 \times 10^{-3}$ |
| Sodium hydroxide | 0.10 |
| Second Layer | |
| Binder: acid-processed gelatin (isoelectric point 9.0) | 3.10 |
| Polymer latex: P-2 | 0.11 |
| Ultraviolet ray absorbent: U-1 | 0.03 |
| Ultraviolet ray absorbent: U-3 | 0.01 |
| Ultraviolet ray absorbent: U-4 | 0.02 |
| Dye: D-2 | 0.09 |
| Dye: D-7 | 0.12 |
| High-boiling organic solvent: Oil-1 | 0.03 |

-continued

| | |
|---|---|
| Surface active agent: W-3 | 0.01 |
| Surface active agent: W-6 | $3.0 \times 10^{-3}$ |
| Potassium sulfate | 0.27 |
| Sodium hydroxide | 0.05 |
| Third Layer | |
| Binder: acid-processed gelatin (isoelectric point 9.0) | 3.30 |
| Surface active agent: W-3 | 0.02 |
| Potassium sulfate | 0.30 |
| Sodium hydroxide | 0.05 |
| Fourth Layer | |
| Binder: lime-processed gelatin (isoelectric point 5.4) | 1.15 |
| Matting agent: B-1 (av. particle diameter 2.0 μm) | 0.04 |
| Matting agent: B-2 (av. particle diameter 2.3 μm) | 0.03 |
| Hardener: H-1 | 0.21 |
| Surface active agent: W-3 | 0.06 |
| Surface active agent: W-2 | $6.0 \times 10^{-3}$ |

Cpd-J

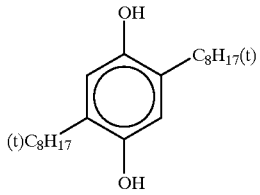

D-7

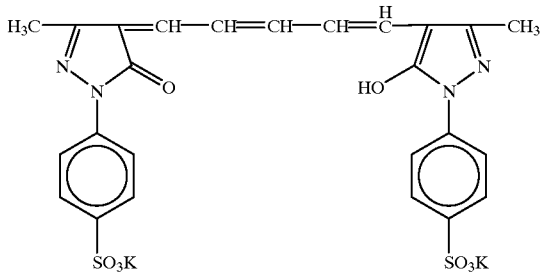

P-2

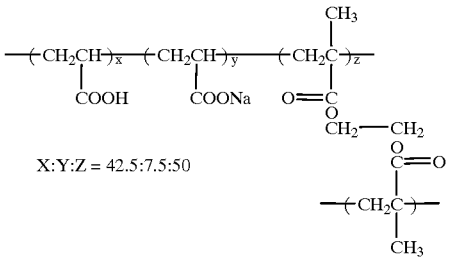

X:Y:Z = 42.5:7.5:50

B-1

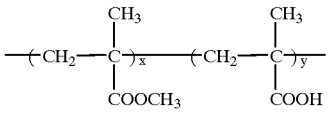

x/y = 90/10

B-2

-continued

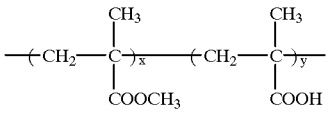

x/y = 60/40

Samples 301 to 304 were evaluated in the same manner as Example 1 and Example 2, and the similar results were obtained.

Example 4

On a cellulose triacetate film support, having a thickness of 205 μm, backing layers having the below composition were provided on one surface of the support, and on the other surface of the support, the same layers in Sample 101 in Example 1, or Samples 201 to 203 in Example 2 were provided, respectively, to prepare Samples 401 to 404.

Composition of Backing Layers

Each figure corresponding to each component, represents the coated amount in terms of g/m$^2$.

| | |
|---|---|
| First Layer | |
| Binder: acid-processed gelatin (isoelectric point 9.0) | 0.70 |
| Polymer latex: P-1 (av. particle diameter 0.1 μm) | 0.08 |
| Polymer latex: P-2 (av. particle diameter 0.2 μm) | 0.15 |
| Ultraviolet ray absorbent: U-1 | 0.02 |
| Ultraviolet ray absorbent: U-3 | $5.0 \times 10^{-3}$ |
| Ultraviolet ray absorbent: U-4 | 0.01 |
| High-boiling organic solvent: Oil-1 | 0.02 |
| Surface active agent: W-3 | 0.01 |
| Surface active agent: W-6 | $2.0 \times 10^{-3}$ |
| Sodium hydroxide | 0.07 |
| Second Layer | |
| Binder: acid-processed gelatin (isoelectric point 9.0) | 5.60 |
| Polymer latex: P-2 | 0.20 |
| Ultraviolet ray absorbent: U-1 | 0.05 |
| Ultraviolet ray absorbent: U-3 | 0.01 |
| Ultraviolet ray absorbent: U-4 | 0.03 |
| Surface active agent: W-3 | 0.03 |
| Surface active agent: W-6 | $5.0 \times 10^{-3}$ |
| High-boiling organic solvent: Oil-1 | 0.06 |
| Potassium sulfate | 0.50 |
| Sodium hydroxide | 0.09 |
| Third Layer | |
| Binder: acid-processed gelatin (isoelectric point 9.0) | 5.00 |
| Surface active agent: W-3 | 0.02 |
| Potassium sulfate | 0.43 |
| Sodium hydroxide | 0.08 |
| Fourth Layer | |
| Binder: acid-processed gelatin (isoelectric point 9.0) | 0.80 |
| Matting agent: B-1 (av. particle diameter 2.0 μm) | 0.02 |
| Matting agent: B-2 (av. particle diameter 2.3 μm) | 0.02 |
| Hardener: H-1 | 0.35 |
| Surface active agent: W-3 | 0.03 |
| Surface active agent: W-2 | $4.0 \times 10^{-3}$ |

Samples 401 to 404 were evaluated in the same manner as Example 1 and Example 2, and the similar results were obtained.

Example 5

(Preparation of Sample 501)

Layers having the below-shown compositions were formed on a cellulose triacetate film support, having a thickness of 127 μm, that had been provided an undercoat, to prepare a multi-layer color light-sensitive material, which was named Sample 501. Each figure represents the added amount per square meter. In passing, it should be noted that the effect of the added compounds is not limited to the described use.

| | |
|---|---|
| First Layer (Halation-preventing layer) | |
| Black colloidal silver | 0.30 g |
| Gelatin | 2.30 g |
| Ultraviolet ray absorbent U-1 | 0.10 g |
| Ultraviolet ray absorbent U-3 | 0.04 g |
| Ultraviolet ray absorbent U-4 | 0.10 g |
| High-boiling organic solvent Oil-1 | 0.10 g |
| Coupler C-9 | 0.12 mg |
| Second Layer (Intermediate layer) | |
| Gelatin | 0.38 g |
| Compound Cpd-A | 5.0 mg |
| Compound Cpd-H | 4.4 mg |
| Ultraviolet ray absorbent U-2 | 3.0 mg |
| High-boiling organic solvent Oil-3 | 0.10 g |
| Dye D-4 | 10.0 mg |
| Third Layer (Intermediate layer) | |
| Yellow colloidal silver | silver 0.007 g |
| Gelatin | 0.40 g |
| Fourth Layer (Low-sensitivity red-sensitive emulsion layer) | |
| Emulsion | silver 0.62 g |
| Gelatin | 0.63 g |
| Coupler C-1 | 0.04 g |
| Coupler C-2 | 0.09 g |
| Compound Cpd-A | 5.0 mg |
| High-boiling organic solvent Oil-2 | 0.10 g |
| Fifth Layer (Medium-sensitivity red-sensitive emulsion layer) | |
| Emulsion | silver 0.42 g |
| Gelatin | 0.65 g |
| Coupler C-1 | 0.05 g |
| Coupler C-2 | 0.11 g |
| High-boiling organic solvent Oil-2 | 0.10 g |
| Sixth Layer (High-sensitivity red-sensitive emulsion layer) | |
| Emulsion | silver 0.50 g |
| Gelatin | 1.70 g |
| Coupler C-3 | 0.70 g |
| Additive P-1 | 0.20 g |
| High-boiling organic solvent Oil-2 | 0.04 g |
| Seventh Layer (Intermediate layer) | |
| Gelatin | 0.60 g |
| Additive M-1 | 0.30 g |
| Compound Cpd-A | 0.05 g |
| Compound Cpd-D | 0.04 g |
| Compound Cpd-I | 0.04 mg |
| High-boiling organic solvent Oil-3 | 0.10 g |
| Eighth Layer (Intermediate layer) | |
| Yellow colloidal silver | silver 0.04 g |
| Gelatin | 1.20 g |
| Compound Cpd-A | 0.10 g |
| High-boiling organic solvent Oil-3 | 0.20 g |
| Ninth Layer (Low-sensitivity green-sensitive emulsion layer) | |
| Emulsion | silver 0.85 g |
| Gelatin | 1.20 g |
| Coupler C-7 | 0.07 g |

-continued

| | |
|---|---|
| Coupler C-8 | 0.17 g |
| Compound Cpd-B | 0.30 mg |
| Compound Cpd-C | 2.00 mg |
| High-boiling organic solvent Oil-2 | 0.10 g |
| Tenth Layer (Medium-sensitivity green-sensitive emulsion layer) | |
| Emulsion | silver 0.53 g |
| Core/shell-type fine grain silver bromide emulsion, inner part of which was fogged (av. grain diameter: 0.11 μm) | silver 0.08 g |
| Gelatin | 0.50 g |
| Coupler C-4 | 0.26 g |
| Compound Cpd-B | 0.03 g |
| High-boiling organic solvent Oil-2 | 0.01 g |
| Eleventh Layer (High-sensitivity green-sensitive emulsion layer) | |
| Emulsion | silver 0.44 g |
| Gelatin | 0.65 g |
| Coupler C-4 | 0.35 g |
| Compound Cpd-B | 0.08 g |
| High-boiling organic solvent Oil-2 | 0.02 g |
| Twelfth Layer (Intermediate layer) | |
| Gelatin | 0.30 g |
| Compound Cpd-A | 0.03 g |
| High-boiling organic solvent Oil-3 | 0.06 g |
| Thirteenth Layer (Yellow filter layer) | |
| Yellow colloidal silver | silver 0.08 g |
| Gelatin | 0.50 g |
| Compound Cpd-A | 0.04 g |
| Compound Cpd-G | 0.02 g |
| High-boiling organic solvent Oil-3 | 0.10 g |
| Fourteenth Layer (Low-sensitivity blue-sensitive emulsion layer) | |
| Emulsion | silver 0.38 g |
| Gelatin | 0.60 g |
| Coupler C-5 | 0.26 g |
| Coupler C-6 | 5.00 g |
| Coupler C-10 | 0.03 g |
| Fifteenth Layer (Medium-sensitivity blue-sensitive emulsion layer) | |
| Emulsion | silver 0.20 g |
| Gelatin | 0.80 g |
| Coupler C-5 | 0.35 g |
| Coupler C-6 | 5.00 g |
| Coupler C-10 | 0.030 g |
| Sixteenth Layer (High-sensitivity blue-sensitive emulsion layer) | |
| Emulsion | silver 0.44 g |
| Gelatin | 2.60 g |

-continued

| | |
|---|---|
| Coupler C-6 | 0.10 g |
| Coupler C-10 | 1.00 g |
| Compound Cpd-E | 0.10 g |
| High-boiling organic solvent Oil-2 | 0.40 g |
| Seventeenth Layer (First protective layer) | |
| Gelatin | 1.00 g |
| Ultraviolet ray absorber U-1 | 0.10 g |
| Ultraviolet ray absorber U-2 | 0.03 g |
| Ultraviolet ray absorber U-5 | 0.20 g |
| Compound Cpd-A | 0.09 g |
| Compound Cpd-F | 0.40 g |
| Dye D-1 | 0.01 g |
| Dye D-2 | 0.05 g |
| Dye D-3 | 0.01 g |
| Dye D-5 | 0.01 g |
| High-boiling organic solvent Oil-3 | 0.30 g |
| Eighteenth Layer (Second protective layer) | |
| Yellow colloidal silver | silver 0.10 mg |
| Silver iodobromide emulsion of fine grains (av. grain diameter: 0.06 μm, AgI content: 1 mol %) | silver 0.10 g |
| Gelatin | 0.70 g |
| Ultraviolet ray absorber U-1 | 0.06 g |
| Ultraviolet ray absorber U-2 | 0.02 g |
| Ultraviolet ray absorber U-5 | 0.12 g |
| High-boiling point organic solvent Oil-1 | 0.07 g |
| Nineteenth Layer (Third protective layer) | |
| Gelatin | 1.40 g |
| Poly(methyl methacrylate) (average grain diameter 1.5 μm) | 5.00 g |
| Copolymer of methyl methacrylate and methacrylic acid (6:4) (average grain diameter 1.5 μm) | 0.10 g |
| Silicon oil SO-1 | 0.030 g |
| Surface active agent W-2 | 0.030 g |

Further, to all emulsion layers, in addition to the above-described components, additives F-1 to F-11 were added. Further, to each layer, in addition to the above-described components, a gelatin hardener H-1 and surface active agents W-1, W-3, W-4, W-5, and W-6 for coating and emulsifying, were added.

Further, as antifungal and antibacterial agents, phenol, 1,2-benzisothiazoline-3-one, 2-phenoxyethanol, phenetylalcohol, and p-hydroxybenzoic acid butyl ester were added.

Light-sensitive emulsions that were used in Sample 501 are illustrated in Table 8.

TABLE 8

Light-sensitive emulsions used in Sample 501

| Used amount | Emulsion | Coated amount of silver ($g/m^2$) | Average aspect ratio of all grains | Diameter of projected area (circle-equivalent) Average diameter (μm) | Diameter of projected area (circle-equivalent) Deviation coefficient (%) | AgI content Average (mol %) | AgI content Deviation coefficient (%) |
|---|---|---|---|---|---|---|---|
| Low-sensitivity red-sensitive emulsion layer | A | 0.28 | 1.0 | 0.24 | 9 | 3.6 | 55 |
| | B | 0.15 | 1.0 | 0.25 | 10 | 3.63 | 50 |
| | C | 0.19 | 1.0 | 0.25 | 7 | 3.3 | 20 |
| Medium-sensitivity red-sensitive emulsion layer | D | 0.42 | 1.0 | 0.43 | 9 | 3.0 | 50 |
| High-sensitivity red-sensitive | E | 0.50 | 4.1 | 0.78 | 24 | 1.6 | 20 |

TABLE 8-continued

| Light-sensitive emulsions used in Sample 501 | | | | | | | |
|---|---|---|---|---|---|---|---|
| emulsion layer | | | | | | | |
| Low-sensitivity | F | 0.23 | 1.0 | 0.18 | 13 | 4.0 | 15 |
| green-sensitive | G | 0.29 | 1.0 | 0.24 | 10 | 4.0 | 50 |
| emulsion layer | H | 0.33 | 1.0 | 0.40 | 8 | 3.9 | 20 |
| Medium-sensitivity green-sensitive emulsion layer | I | 0.53 | 1.0 | 0.52 | 9 | 3.2 | 20 |
| High-sensitivity green-sensitive emulsion layer | K | 0.44 | 4.5 | 1.04 | 26 | 2.8 | 65 |
| Low-sensitivity | L | 0.11 | 1.0 | 0.51 | 9 | 4.7 | 15 |
| blue-sensitive | M | 0.10 | 1.0 | 0.52 | 9 | 4.7 | 20 |
| emulsion layer | N | 0.17 | 1.0 | 0.52 | 9 | 4.7 | 35 |
| Medium-sensitivity | O | 0.1 | 4.1 | 0.64 | 20 | 2.0 | 35 |
| blue-sensitive emulsion layer | P | 0.1 | 4.1 | 0.75 | 17 | 1.0 | 30 |
| High-sensitivity | Q | 0.20 | 4 | 0.80 | 25 | 1.0 | 65 |
| blue-sensitive emulsion layer | R | 0.24 | 5 | 1.20 | 25 | 0.8 | 20 |

| Used amount | Emulsion | Feature of grain | Ratio of (111) plane on surface | Kind of sensitizing dye added | | |
|---|---|---|---|---|---|---|
| | | | | Kind | Kind | Kind |
| Low-sensitivity | A | Tetradecahedral grain | 45 | S-1 | S-13 | — |
| red-sensitive | B | Tetradecahedral grain | 35 | S-2 | S-3 | — |
| emulsion layer | C | Cubic grain | 0 | S-2 | S-3 | |
| Medium-sensitivity red-sensitive emulsion layer | D | Tetradecahedral grain | 50 | S-1 | S-3 | — |
| High-sensitivity red-sensitive emulsion layer | E | Tabular grain | 90 | S-1 | S-2 | S-3 |
| Low-sensitivity | F | Cubic grain | 2 | S-4 | S-5 | — |
| green-sensitive | G | Cubic grain | 1 | S-4 | S-5 | — |
| emulsion layer | H | Cubic grain | 0 | S-4 | S-5 | — |
| Medium-sensitivity green-sensitive emulsion layer | I | Cubic grain | 0 | S-4 | S-9 | S-10 |
| High-sensitivity green-sensitive emulsion layer | K | Tabular grain | 98 | S-8 | S-9 | S-14 |
| Low-sensitivity | L | Tetradecahedral grain | 55 | S-11 | S-12 | — |
| blue-sensitive | M | Tetradecahedral grain | 50 | S-11 | S-12 | — |
| emulsion layer | N | Tetradecahedral grain | 45 | S-11 | S-12 | — |
| Medium-sensitivity | O | Tabular grain | 98 | S-11 | S-12 | — |
| blue-sensitive emulsion layer | P | Tabular grain | 99 | S-11 | S-12 | — |
| High-sensitivity | Q | Tabular grain | 99 | S-11 | S-12 | — |
| blue-sensitive emulsion layer | R | Tabular grain | 99 | S-11 | S-12 | — |

Note 1) Each of emulsions described above was a core/shell-type emulsion having a high-iodide phase in the emulsion grain, and each emulsion was subjected to gold/sulfur/selenium sensitization or gold/sulfur sensitization.
Note 2) To each emulsion described above, compounds F-5, F-7, F-8, F-9, F-10, and F-11 were added appropriately.
Note 3) Ratio of (111) plane on surface was determined by a method with Kubelka-Munk.
Note 4) Emulsion C was a negative-type emulsion capable of forming a latent image in the grain.

C-1

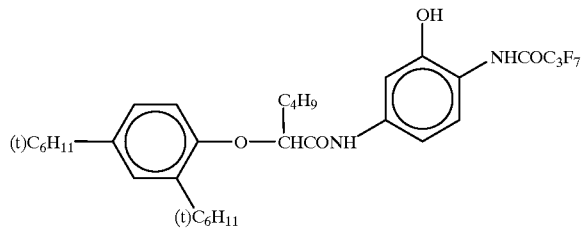

TABLE 8-continued
Light-sensitive emulsions used in Sample 501
C-2
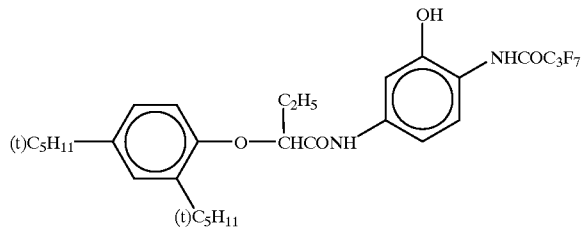
C-3
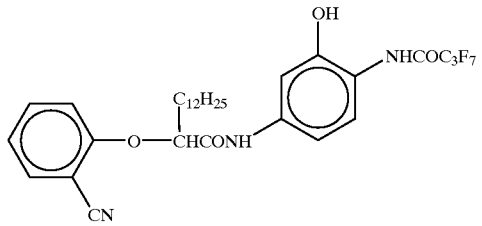
C-4
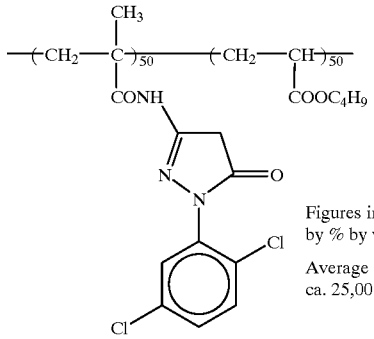
Figures indicates amounts by % by weight
Average molecular weight: ca. 25,000
C-5
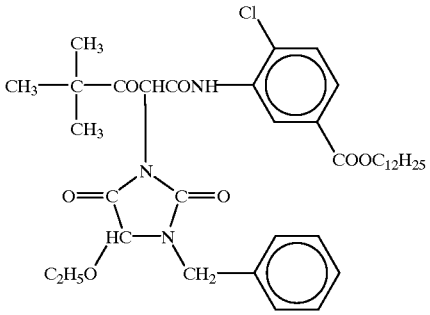
C-6
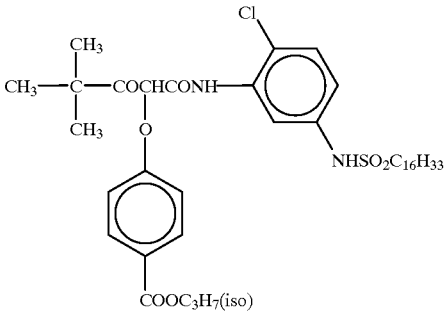
C-7
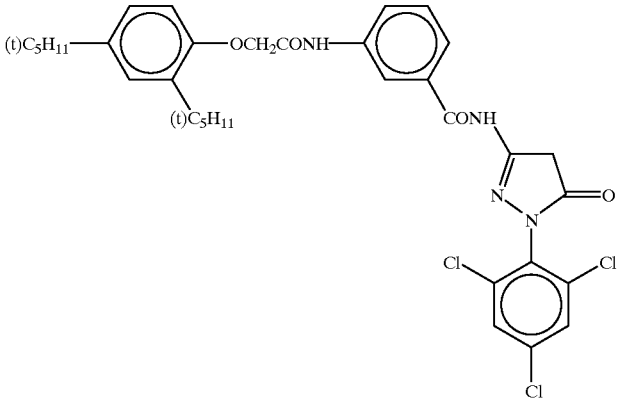

TABLE 8-continued
| Light-sensitive emulsions used in Sample 501 | |
|---|---|
| C-8 | 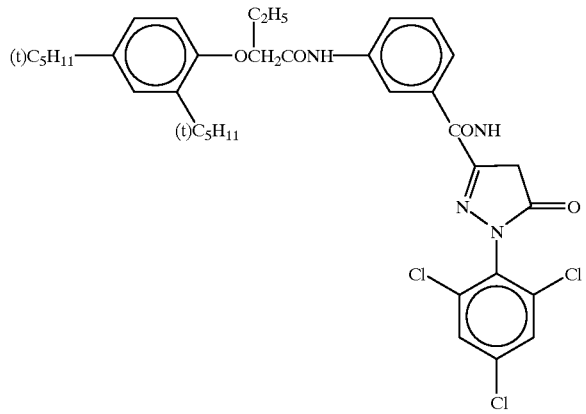 |
| C-9 | 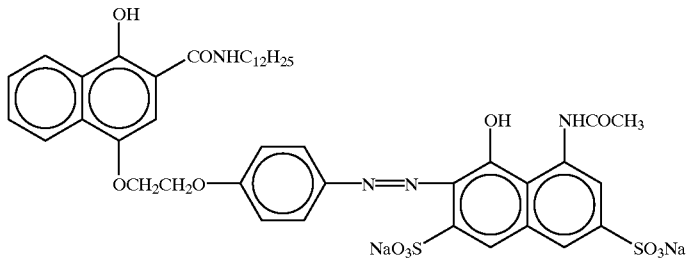 |
| C-10 | 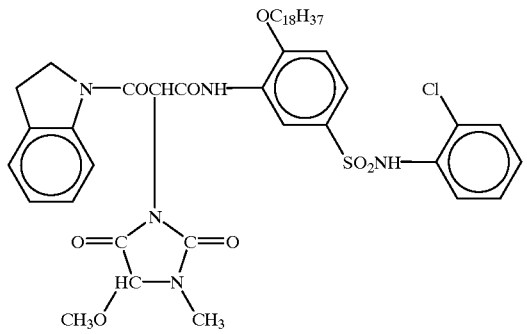 |
| Oil-1 | Dibutyl phthalate |
| Oil-2 | Tricresyl phosphate |
| Oil-3 | 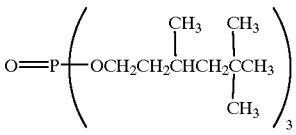 |
| Cpd-A | 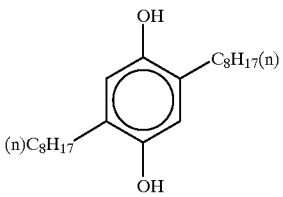 |

TABLE 8-continued
Light-sensitive emulsions used in Sample 501
Cpd-B
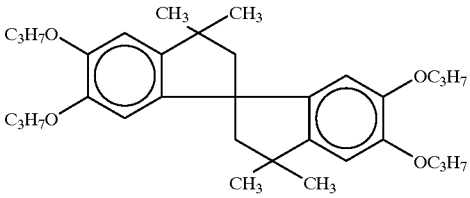
Cpd-C
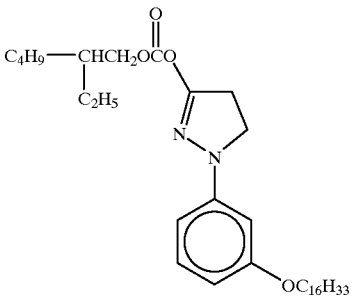
Cpd-D
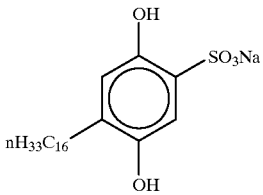
Cpd-E
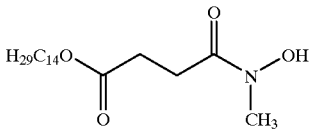
Cpd-F
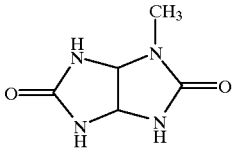
Cpd-G
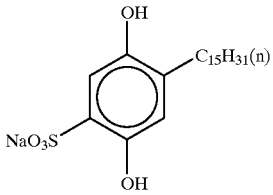
Cpd-H
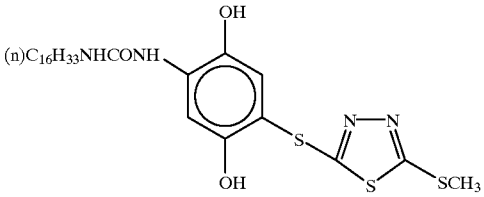
Cpd-I
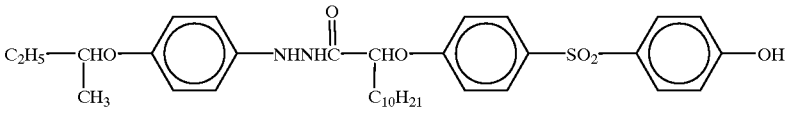
U-1
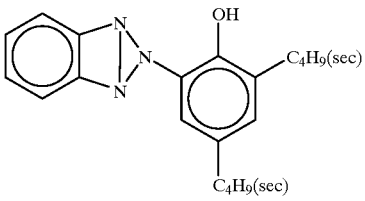
U-2
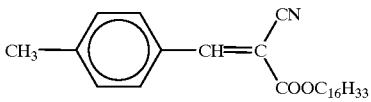
U-3
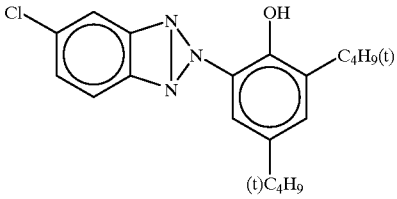
U-4
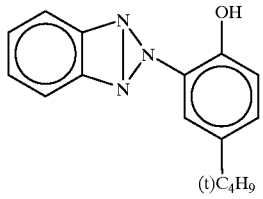

TABLE 8-continued
| Light-sensitive emulsions used in Sample 501 |
|---|
| U-5 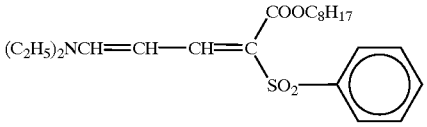 |
| S-1 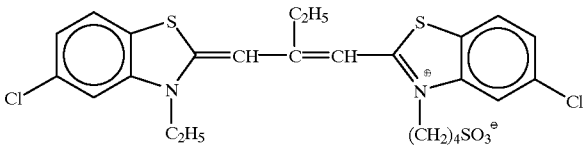 |
| S-2 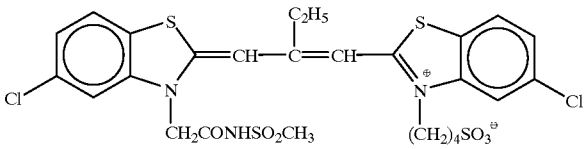 |
| S-3 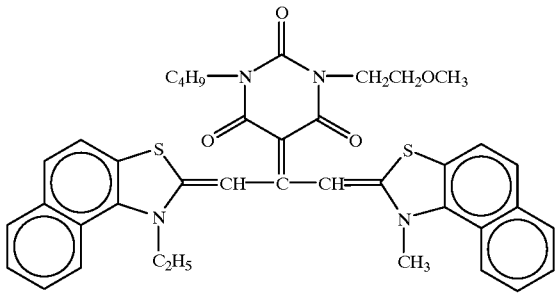 |
| S-4 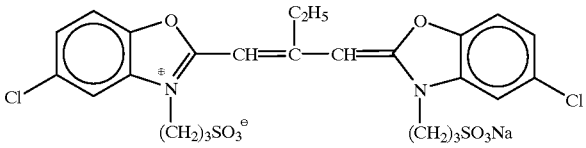 |
| S-5 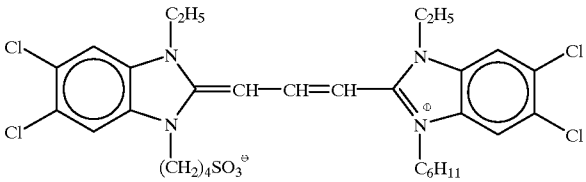 |
| S-6 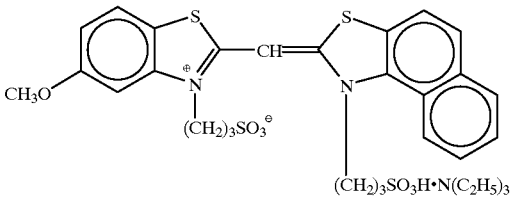 |

TABLE 8-continued
| Light-sensitive emulsions used in Sample 501 |
|---|
| S-7 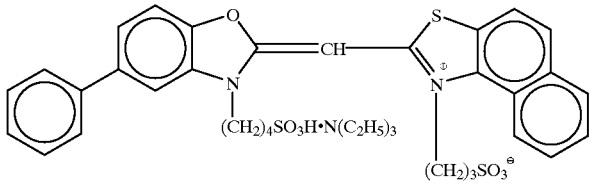 |
| S-8 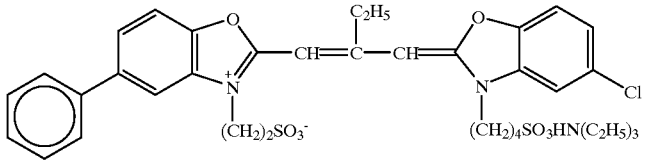 |
| S-9 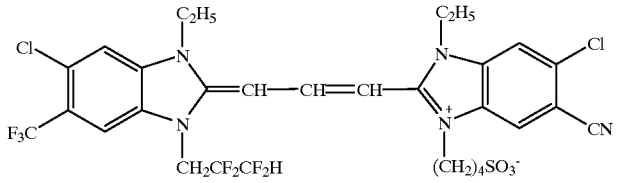 |
| S-10 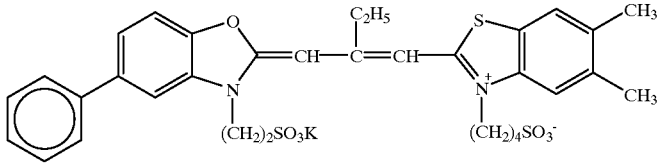 |
| S-11 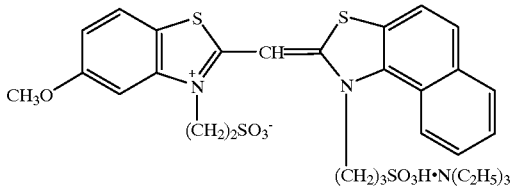 |
| S-12 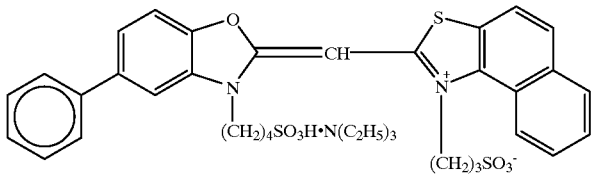 |
| S-13 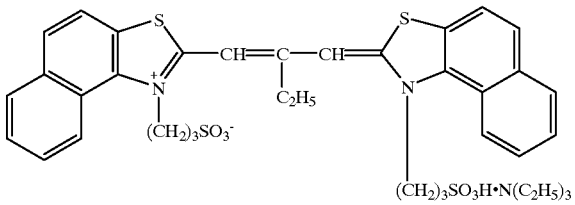 |

TABLE 8-continued
| Light-sensitive emulsions used in Sample 501 |
|---|
| S-14 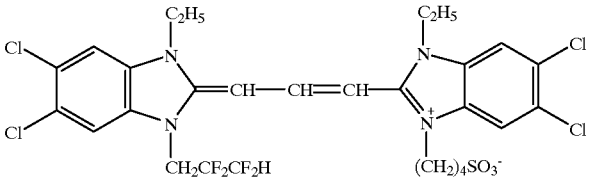 |
| D-1 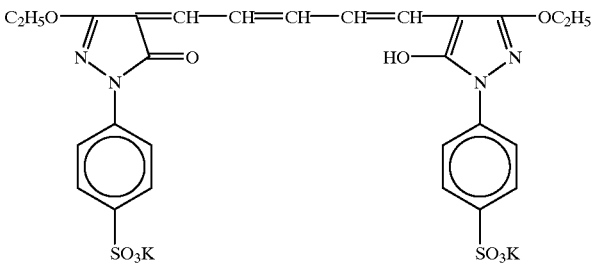 |
| D-2 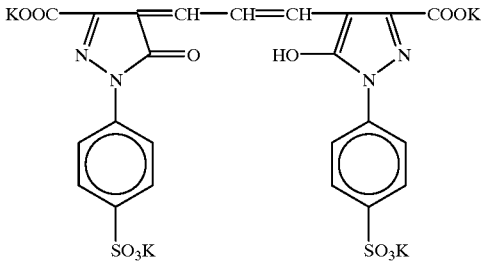 |
| D-3 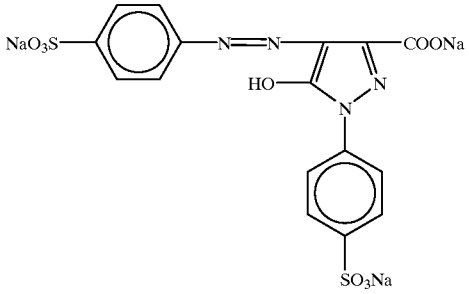 |
| D-4 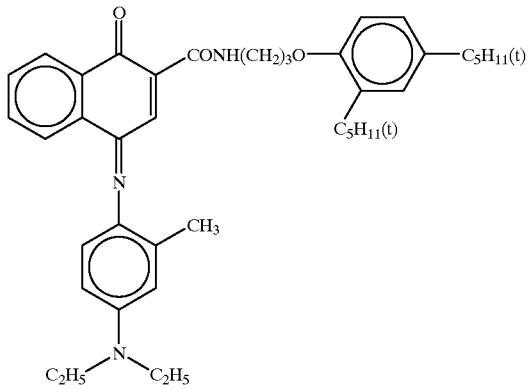 |

TABLE 8-continued
| Light-sensitive emulsions used in Sample 501 | |
|---|---|
| D-5 | 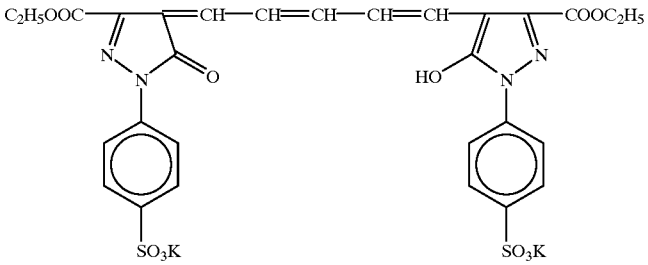 |
| D-6 | 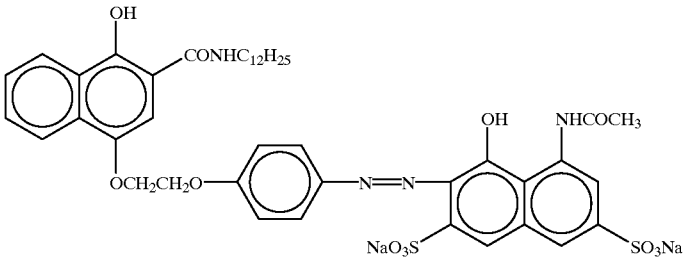 |
| E-1 | 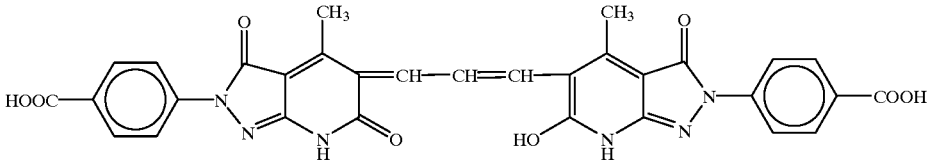 |
| E-2 | 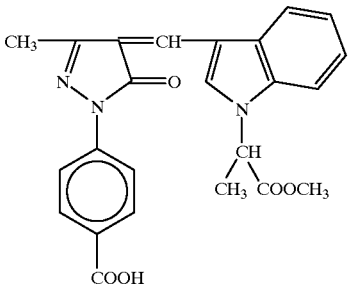 |
| E-3 | 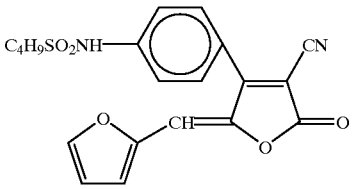 |
| H-1 | 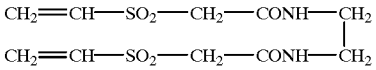 |
| W-1 | $H_{25}C_{12}$—O—$SO_3H.Na$ |
| W-2 | 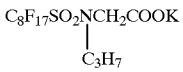 |
| W-3 | 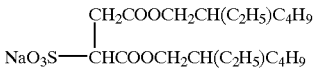 |
| W-4 | 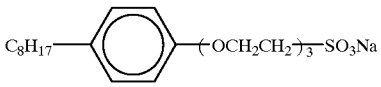 |

TABLE 8-continued
Light-sensitive emulsions used in Sample 501
W-5
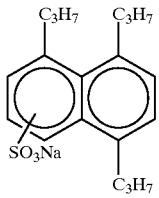
W-6
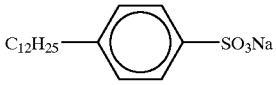
P-1
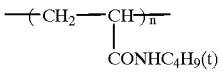
M-1
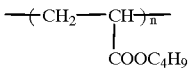
SO-1
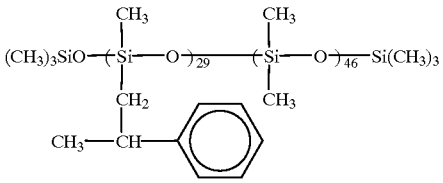
F-1
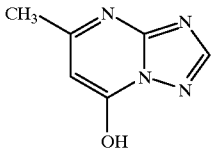
F-2
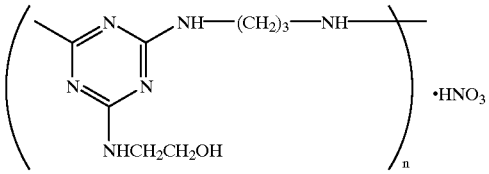
(n = 3~4)
F-3
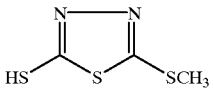
F-4
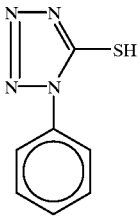
F-5
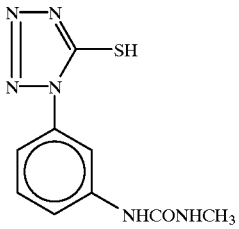
F-6
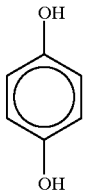
F-7
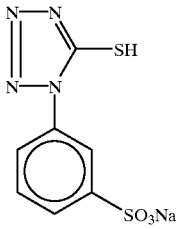
F-8
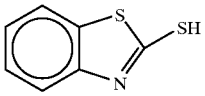
F-9
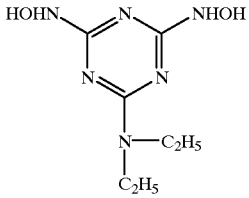

TABLE 8-continued

| Light-sensitive emulsions used in Sample 501 | | | |
|---|---|---|---|
| F-10 | 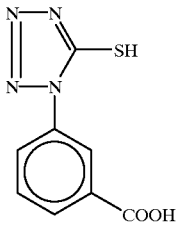 | F-11 | 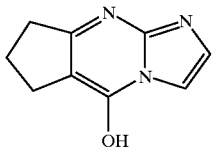 |

(Evaluation of Samples)

The spectral distribution under the standard illumination of each of the colors (relative spectral luminance) was calculated from the spectral reflectances of "gray," "(fair) skin tone," and "red-tint skin tone," as shown in the above-mentioned Tables 3 and 4, multiplied by the spectral distribution of an ISO sensitometric daylight source ($D_{55}$).

The above spectral distribution was generated by a spectrosensitometer device that is able to produce any of the spectral distributions by using an intensity modulating-type mask formed by arranging liquid crystal panels in the stripe form, and further by electrically controlling the transmittance of each of the liquid crystal segments.

The spectrosensitometer device that is able to generate the above-described spectral distribution was manufactured with reference to the reports presented by Enomoto et al. in the Annual Meeting of SPSTJ '90.

As illustrated in FIG. 1, a xenon arc lamp having a high luminance was used as a light source, and in addition, a cylindrical lens was used in the optical system, thereby obtaining a long slit light extended to the grating direction of a diffraction grating. A light separated by a transmission-type diffraction grating acts as a spectral face having a wavelength region of from.400 nm to 700 nm at the dispersion face. Onto this spectral face, were placed liquid crystal panels composed of 60 segments, in which 1 segment is 5 nm, and transmittance was controlled at intervals of 5 nm, thereby obtaining an objective spectral distribution.

A color-mixed slit light was formed on the surface of exposure to light, and the exposure to light was performed by scanning the sample 501 of the present invention and commercially available color reversal film articles, designated Articles A to H, on each of which an optical wedge was placed, at an orthogonal direction to the slit light.

These samples thus exposed to light, each having a spectral distribution of "gray," "skin tone," and "red-tint skin tone," were subjected to the processing described below (processing A), to obtain an image. Densitometry of the thus-obtained image was carried out, respectively. The measurement of the "gray", "skin tone", and the "red-tint skin tone," each of which was reproduced by these samples, was carried out under the observational condition based on an isochromatic test in which twice sight (2-degree calorimetric observation) was adopted at the 1931 CIE (Commission Internationale de I'Eclairage) conference.

Further, to calculate CIE Lab values, the 1976 CIE (L* , a* , b*) isometric perceptive color space calculations were used. For a more detailed explanation of the above-mentioned calculations, reference was made to, for example, *New-Edition Color Science Handbook*, edited by the publication party of Tokyo University (1980), Chapter 4.

Further, the above-described samples were each cut into patches of size 4×5 inches, and pictures of a white (Caucasian) man and woman, and a Japanese man and woman (the yellow race), as models, were taken on the patch samples, followed by the above-mentioned development processing. Photographic properties of each processed sample were evaluated by visual sensitive evaluation. At this time, a picture of a Mansell N=5 color standard was simultaneously taken. When the C* value was not less than 0.5, a color compensating filter was inserted for each sample, to correct so that the C* value was not more than 0.5 and the pictures were taken, in the same manner as the above-mentioned evaluation of CIE Lab values. The evaluation was performed by ten (10) testers. The "change of tint due to skin color density", the "appearance of red-tint (deviation of red tint arisen) in the skin tone", and the "tint of skin color" ware evaluated in accordance with the following three evaluation grades.

| Marks | Evaluation |
|---|---|
| 2 | Very good |
| 1 | Normal |
| 0 | Poor |

The evaluation values were represented by average values of the marks given by the ten (10) testers.

The above-mentioned evaluation results are shown in Table 9 below.

TABLE 9

Color reproduction by Sample 501 and Articles A to H

| | Sample 101 | Article A | Article B | Article C | Article D | Article E | Article F | Article G | Article H |
|---|---|---|---|---|---|---|---|---|---|
| Standard deviation of hue angle of "skin color" image in CIE Lab color specification system in the range of L* = 20 to 70 | 0.55 | 2.81 | 2.53 | 5.63 | 1.38 | 3.13 | 7.44 | 2.14 | 6.58 |
| Standard deviation of hue angle of | 0.84 | 1.93 | 1.57 | 4.02 | 0.79 | 2.45 | 3.24 | 1.75 | 2.63 |

TABLE 9-continued

| Color reproduction by Sample 501 and Articles A to H | Sample 101 | Article A | Article B | Article C | Article D | Article E | Article F | Article G | Article H |
|---|---|---|---|---|---|---|---|---|---|
| "red-tint skin color" image in CIE Lab color specification system in the range of L* = 20 to 70 | | | | | | | | | |
| Standard deviation of hue angle of "skin color" image in CIE Lab color specification system in the range of L* = 30 to 65 | 0.59 | 1.96 | 2.21 | 4.44 | 1.47 | 0.93 | 4.12 | 1.51 | 5.22 |
| Standard deviation of hue angle of "red-tint skin color" image in CIE Lab color specification system in the range of L* = 30 to 65 | 0.37 | 1.30 | 1.70 | 3.15 | 0.37 | 1.55 | 1.57 | 1.18 | 2.45 |
| Maximum difference in hue angles between "skin color" image and "red-tint skin color" image, in the range of L* = 20 to 70 | 20 | 31 | 28 | 27 | 25 | 26 | 32 | 31 | 44 |
| C* maximum value of "gray" image in CIE Lab color specification system in the range of L* = 10 to 80 | 8.7 | 10.8 | 13.5 | 9.8 | 12.1 | 13.8 | 14.9 | 14.7 | 14.2 |
| Change of tint due to skin color density of models | 1.9 | 0.7 | 0.6 | 0.3 | 1.4 | 0.7 | 0.1 | 1.2 | 0.3 |
| Deviation of red-tint of skin color of models | 1.9 | 1.2 | 1.3 | 0.3 | 0.7 | 1.3 | 1.2 | 1.3 | 1.8 |
| Tint of skin color of models | 1.9 | 1.2 | 1.3 | 1.2 | 0.7 | 0.8 | 0.9 | 0.8 | 0.5 |

As is apparent from the results shown in Table 9, with respect to Sample 501 of the present invention, the values of the standard deviation of the hue angle in the CIE Lab color specification system of the "(fair) skin tone" image and the "red-tint skin tone" image, that were reproduced by the light-sensitive material (Sample 101 ), were within 1.0, respectively, in the range of L*=20 to 70, and the maximum difference in hue angle in the CIE Lab color specification system between the "skin tone" and the "red-tint skin tone", was within 30 ° in the range of L*=20 to 70.

Further, with respect to Sample 501 of the present invention, it is found that maximum of the C* value in the CIE Lab color specification system of a "gray" image, that was reproduced by the light-sensitive material (Sample 101 ), was not more than 10 in the range of L*=10 to 80, and the Sample 501 was also excellent in gray reproduction ranging from low lightness (L*=20) to high lightness (L*=70 ).

On the other hand, with respect to any of the commercially available color reversal film articles, designated Articles A to H, the values of the standard deviation of the hue angle in the CIE Lab color specification system of the "fair skin color" and the "red-tint skin tone," that were reproduced by these articles, were not within 1.0, respectively, in the range of L*=20 to 70, or alternatively the values of the maximum difference in the hue angle in the CIE Lab color specification system between the "fair skin tone" and the "red-tint skin tone," were not within 30°, in the range of L*=20 to 70.

Figure 2:
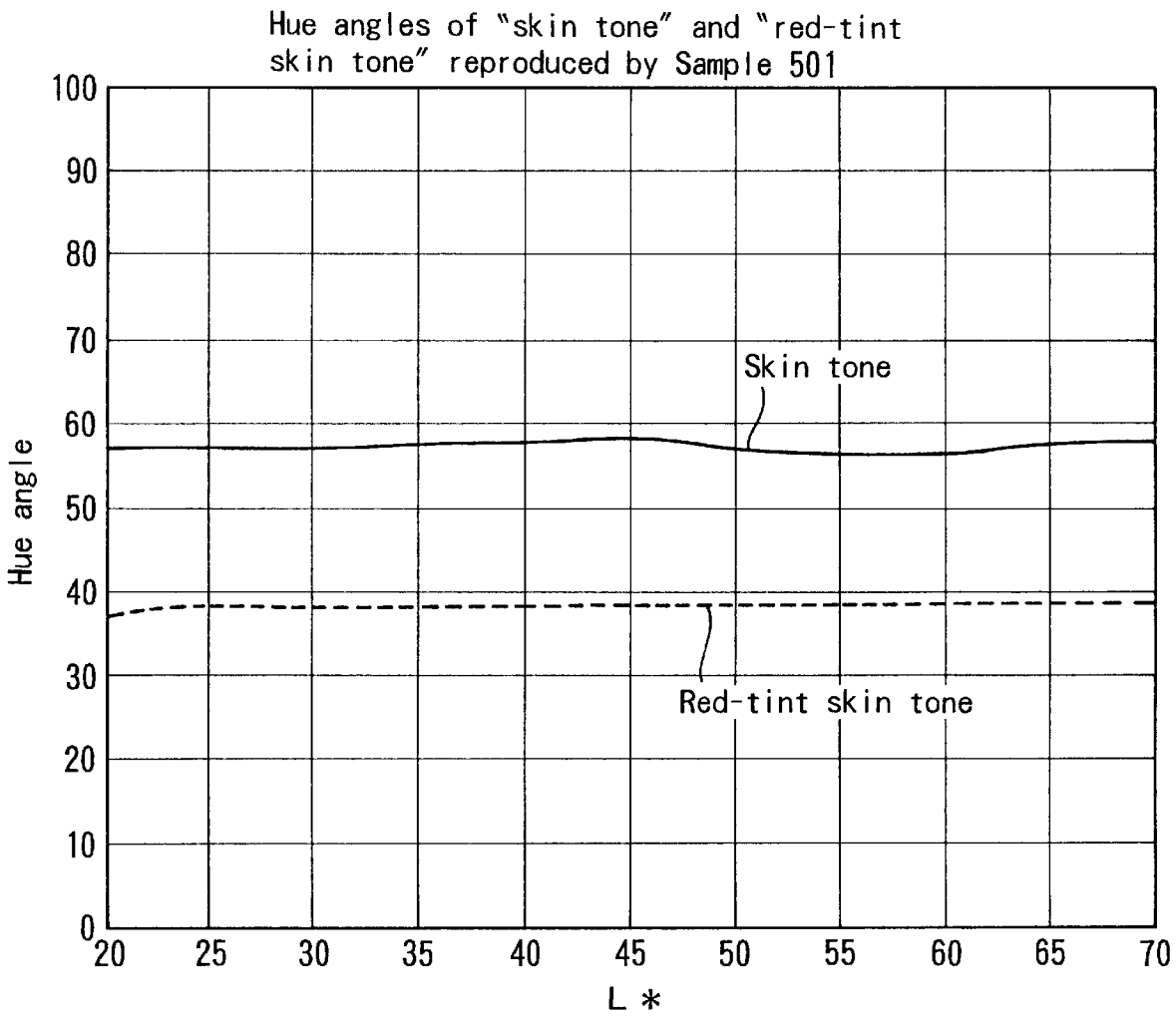
FIG. 2 is a graph showing hue angles of "skin tone" and "red-tint skin tone," that were each reproduced by Sample 501 of the present invention.
Figure 3:
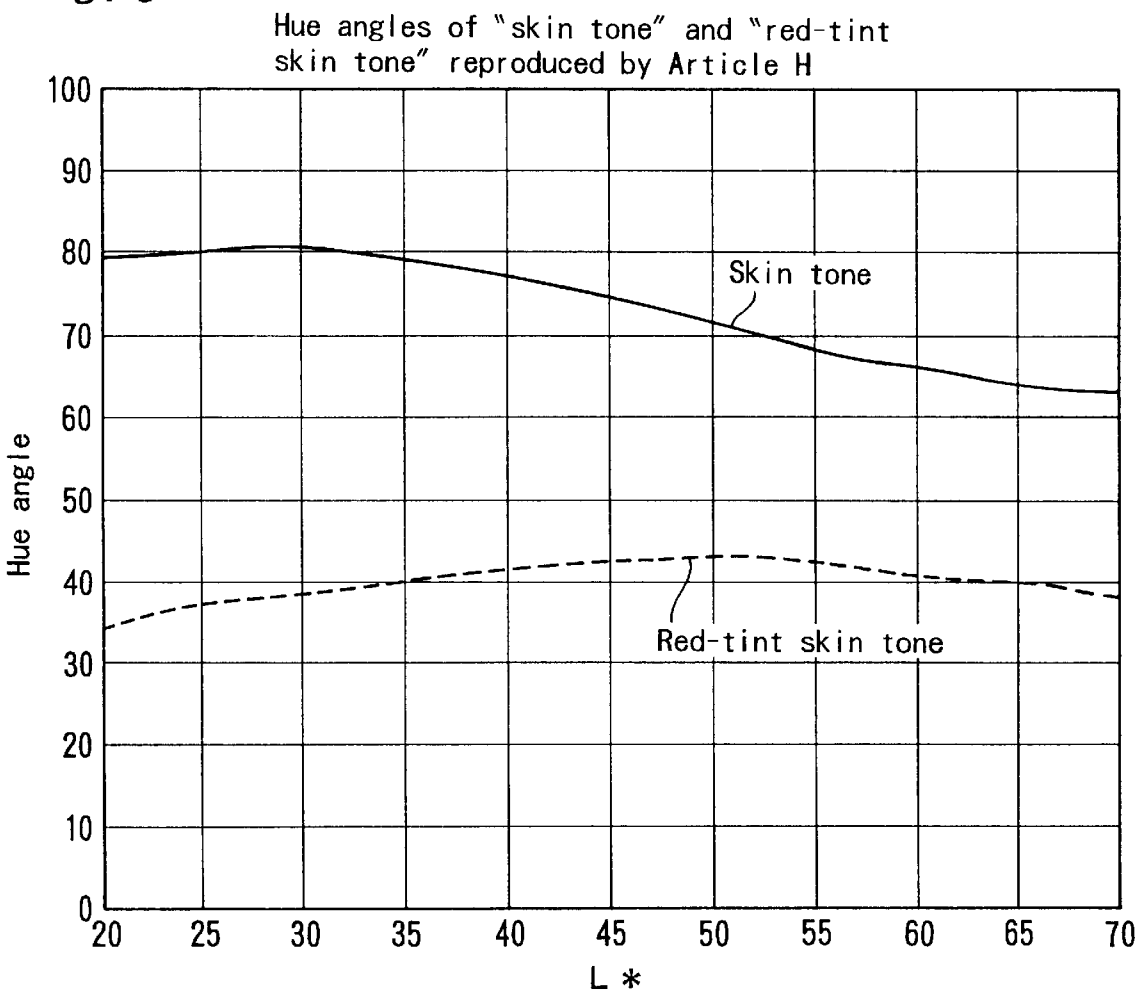
FIG. 3 is a graph showing hue angles of "skin tone" and "red-tint skin tone," that were each reproduced by Article H.

FIGS. 2 and 3 show hue angles of the "fair skin tone" and "red-tint skin tone" in the range of L*=20 to 70, that were each reproduced by Sample 501 of the present invention and the article H, the latter serving as a representative of commercially available color reversal film articles.

As is apparent from FIGS. 2 and 3, compared to the Article H, the values of the standard deviation of the hue angle of the "fair skin tone" and the "red-tint skin tone," that were each reproduced by Sample 501 of the present invention, were quite smaller, and the maximum difference in the hue angle between the "fair skin tone" and the "red-tint skin tone" was also quite smaller, respectively, ranging from low lightness (L*=20) to high lightness (L*=70). These results indicate that the Sample 501 of the present invention is a color reversal photographic light-sensitive material that is excellent in skin color reproduction, in which the continuity of hue of the skin color is good. Such very desirable skin color reproduction was attained only by the Sample 501 of the present invention, and not by either the Article H or any other commercially available color reversal film articles.

Further, from the results obtained by taking the above-mentioned picture of the models, it is also apparent that the Sample 501 is very excellent in skin color reproduction.

(Processing A)

| Processing step | Time | Temperature | Tank volume | Replenisher amount |
|---|---|---|---|---|
| 1st development | 6 min | 38° C. | 12 liters | 2,200 ml/m$^2$ |
| 1st water-washing | 2 min | 38° C. | 4 liters | 7,500 ml/m$^2$ |
| Reversal | 2 min | 38° C. | 4 liters | 1,100 ml/m$^2$ |
| Color development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 2 liters | 220 ml/m$^2$ |
| Fixing | 4 min | 38° C. | 8 liters | 1,100 ml/m$^2$ |
| 2nd water-washing | 4 min | 38° C. | 8 liters | 7,500 ml/m$^2$ |
| Final-rinsing | 1 min | 25° C. | 2 liters | 1,100 ml/m$^2$ |

Compositions of each processing solution used were as follows:

| First developer | Tank solution | Replenisher |
|---|---|---|
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |

-continued

| | | |
|---|---|---|
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |

| Reversal solution (Both tank solution and replenisher) | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |
| (pH was adjusted by using acetic acid or sodium hydroxide) | |

| Color developer | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline.3/2 sulfate. mono hydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using sulfuric acid or potassium hydroxide) | | |

| Pre-bleaching solution | Tank Solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde.sodium bisulfite adduct | 30 g | 35 g |
| Water to make | 1,000 ml | 1,000 ml |
| pH | 6.30 | 6.10 |
| (pH was adjusted by using acetic acid or sodium hydroxide) | | |

| Bleaching solution | Tank solution | Replenisher |
|---|---|---|
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1.000 ml |
| pH | 5.70 | 5.50 |
| (pH was adjusted by using nitric acid or sodium hydroxide) | | |

| Fixing solution (Both tank solution and replenisher) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |
| (pH was adjusted by using acetic acid or aqueous ammonia) | |

| Stabilizing solution | Tank solution | Replenisher |
|---|---|---|
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

Example 6

(Preparation of Sample 601)

Sample 601 was prepared by providing a gelatin intermediate layer (gelatin coating amount: 0.30 g) between the thirteenth layer (yellow filter layer) and the fourteenth layer (low-sensitivity blue-sensitive layer) of Sample 501 in Example 5.

(Preparation of Sample 602)

Sample 602 was prepared in the same manner as Sample 601, except that protective layers were changed as shown below.

| Eighteenth Layer (First protective layer) | |
|---|---|
| Gelatin | 1.30 g |
| Ultraviolet ray absorber U-1 | 0.16 g |
| Ultraviolet ray absorber U-2 | 0.05 g |
| Ultraviolet ray absorber U-5 | 0.32 g |
| Compound Cpd-A | 0.09 g |
| Compound Cpd-F | 0.40 g |
| Dye D-1 | 0.01 g |
| Dye D-2 | 0.05 g |
| Dye D-3 | 0.01 g |
| Dye D-5 | 0.01 g |
| High-boiling organic solvent Oil-2 | 0.37 g |
| Nineteenth Layer (Second protective layer) | |
| Yellow colloidal silver | silver 0.10 mg |
| Silver iodobromide emulsion of fine grains (av. grain diameter: 0.06 μm, AgI content: 1 mol %) | silver 0.10 g |
| Gelatin | 1.80 g |
| Poly(methyl methacrylate) (average grain diameter 1.5 μm) | 5.00 g |
| Copolymer of methyl methacrylate and methacrylic acid (6:4) (average grain diameter 1.5 μm) | 0.10 g |
| Silicon oil SO-1 | 0.030 g |
| Surface active agent W-2 | 0.030 g |

(Preparation of Sample 603)

Preparation of a Dispersion of Organic Solid Dispersed Dye

Dye E-1 was dispersed in accordance with the following method. To 1430 g of a wet cake of the dye containing methanol in an amount of 30 %, water and 200 g of Pluronic F88, trade name, manufactured by BASF Co. (ethylene oxide/propylene oxide block copolymer), were added, with stirring, to prepare a slurry having the dye content of 6%. Then, 1700 ml of zirconia beads having an average diameter of 0.5 mm was filled into ULTRAVISCOMILL (UVM-2), manufactured by IMEX Co., Ltd., through which the above-obtained slurry was passed and ground at the round speed of about 10 m/sec and a discharge rate of 0.5 liters/min for 8 hrs. After the beads were removed from the slurry by filtration, the filtrate was added to water, in order to dilute the dye density to 3%, followed by heating at 90° C. for 10 hrs, for stabilization. The thus-obtained fine particles of the dye had an average particle diameter of 0.60 μm and a range of particle diameter distribution (standard deviation of particle diameter ×100/average diameter) of 18%.

In the similar manner, solid dispersions of Dye E-2 or E-3 were obtained, respectively. These dye fine particles had average particle diameters of 0.54 μm and 0.56 μm, respectively.

Sample 603 was prepared in the same manner as Sample 602, except that 0.10 g of the fine crystal solid dispersion of Dye E-1 was added in the first layer (halation preventing layer) of Sample 602, the twelfth layer (intermediate layer) of Sample 602 was removed, 0.03 g and 0.02 g of fine crystal solid dispersion of Dye E-2 and E-3 were added, respectively, to the thirteenth layer (yellow filter layer) of Sample 602, and the amount of yellow colloidal silver in the thirteenth layer (yellow filter layer) of Sample 602 was reduced to 0.02 g.

Sample 601 to 603 were evaluated in the same manner as in Example 5.

The evaluation results obtained are shown in Table 10. As same to Sample 501 in Example 5, similar favorable results were obtained in Sample 601 to 603.

TABLE 10

Color reproduction of Samples 201 to 203

| | Sample 201 | Sample 202 | Sample 203 |
|---|---|---|---|
| Standard deviation of hue angle of "skin color" image in CIE Lab color specification system in the range of L* = 20 to 70 | 0.59 | 0.58 | 0.59 |
| Standard deviation of hue angle of "red-tint skin color" image in CIE Lab color specification system in the range of L* = 20 to 70 | 0.80 | 0.77 | 0.82 |
| Standard deviation of hue angle of "skin color" image in CIE Lab color specification system in the range of L* = 30 to 65 | 0.57 | 0.56 | 0.57 |
| Standard deviation of hue angle of "red-tint skin color" image in CIE Lab color specification system in the range of L* = 30 to 65 | 0.36 | 0.34 | 0.37 |
| Maximum difference in hue angles between "skin color" image and "red-tint skin color" image, in the range of L* = 20 to 70 | 20 | 21 | 23 |
| C* maximum value of "gray" image in CIE Lab color specification system in the range of L* = 10 to 80 | 4.8 | 8.9 | 7.8 |
| Change of tint due to skin color density of models | 2.0 | 1.9 | 1.9 |
| Deviation of red-tint of skin color of models | 2.0 | 1.8 | 1.9 |
| Tint of skin color of models | 2.0 | 1.8 | 1.9 |

Example 7

On a cellulose triacetate film support, having a thickness of 95 μm, backing layers having the below composition were provided on one surface of the support, and on the other surface of the support, the same layers in Sample 501 in Example 5, or Samples 601 to 603 in Example 6 were provided, respectively, to prepare Samples 701 to 704.

Composition of Backing Layers

Each figure corresponding to each component, represents the coated amount in terms of g/m$^2$.

| | |
|---|---|
| **First Layer** | |
| Binder: acid-processed gelatin (isoelectric point 9.0) | 1.00 |
| Polymer latex: P-1 (av. particle diameter 0.1 μm) | 0.13 |
| Polymer latex: P-2 (av. particle diameter 0.2 μm) | 0.23 |
| Ultraviolet ray absorbent: U-1 | 0.03 |
| Ultraviolet ray absorbent: U-3 | 0.01 |
| Ultraviolet ray absorbent: U-4 | 0.02 |
| High-boiling organic solvent: Oil-1 | 0.03 |
| Surface active agent: W-3 | 0.01 |
| Surface active agent: W-6 | $3.0 \times 10^{-3}$ |
| Sodium hydroxide | 0.10 |
| **Second Layer** | |
| Binder: acid-processed gelatin (isoelectric point 9.0) | 3.10 |
| Polymer latex: P-2 | 0.11 |
| Ultraviolet ray absorbent: U-1 | 0.03 |
| Ultraviolet ray absorbent: U-3 | 0.01 |
| Ultraviolet ray absorbent: U-4 | 0.02 |
| Dye: D-2 | 0.09 |
| Dye: D-7 | 0.12 |
| High-boiling organic solvent: Oil-1 | 0.03 |
| Surface active agent: W-3 | 0.01 |
| Surface active agent: W-6 | $3.0 \times 10^{-3}$ |
| Potassium sulfate | 0.27 |
| Sodium hydroxide | 0.05 |
| **Third Layer** | |
| Binder: acid-processed gelatin (isoelectric point 9.0) | 3.30 |
| Surface active agent: W-3 | 0.02 |
| Potassium sulfate | 0.30 |
| Sodium hydroxide | 0.05 |
| **Fourth Layer** | |
| Binder: lime-processed gelatin (isoelectric point 5.4) | 1.15 |
| Matting agent: B-1 (av. particle diameter 2.0 μm) | 0.04 |
| Matting agent: B-2 (av. particle diameter 2.3 μm) | 0.03 |
| Hardener: H-1 | 0.21 |
| Surface active agent: W-3 | 0.06 |
| Surface active agent: W-2 | $6.0 \times 10^{-3}$ |

Cpd-J

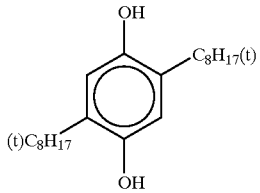

D-7

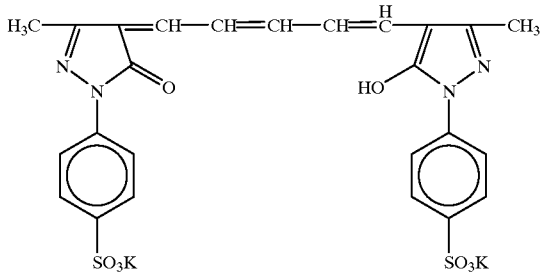

-continued

P-2

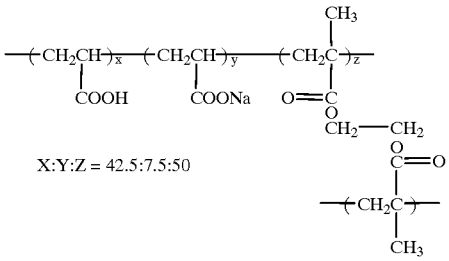

X:Y:Z = 42.5:7.5:50

B-1

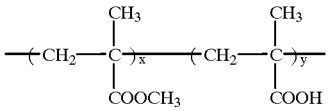

x/y = 90/10

B-2

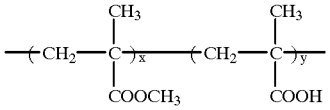

x/y = 60/40

Samples 701 to 704 were evaluated in the same manner as Example 5 and Example 6, and the similar results were obtained.

Example 8

On a cellulose triacetate film support, having a thickness of 205 $\mu$m, backing layers having the below composition were provided on one surface of the support, and on the other surface of the support, the same layers in Sample 501 in Example 5, or Samples 601 to 603 in Example 6 were provided, respectively, to prepare Samples 801 to 804.

Composition of Backing Layers

Each figure corresponding to each component, represents the coated amount in terms of g/m$^2$.

| | |
|---|---|
| First Layer | |
| Binder: acid-processed gelatin (isoelectric point 9.0) | 0.70 |
| Polymer latex: P-1 (av. particle diameter 0.1 $\mu$m) | 0.08 |
| Polymer latex: P-2 (av. particle diameter 0.2 $\mu$m) | 0.15 |
| Ultraviolet ray absorbent: U-1 | 0.02 |
| Ultraviolet ray absorbent: U-3 | $5.0 \times 10^{-3}$ |
| Ultraviolet ray absorbent: U-4 | 0.01 |
| High-boiling organic solvent: Oil-1 | 0.02 |
| Surface active agent: W-3 | 0.01 |
| Surface active agent: W-6 | $2.0 \times 10^{-3}$ |
| Sodium hydroxide | 0.07 |
| Second Layer | |
| Binder: acid-processed gelatin (isoelectric point 9.0) | 5.60 |
| Polymer latex: P-2 | 0.20 |
| Ultraviolet ray absorbent: U-1 | 0.05 |
| Ultraviolet ray absorbent: U-3 | 0.01 |
| Ultraviolet ray absorbent: U-4 | 0.03 |
| Surface active agent: W-3 | 0.03 |

-continued

| | |
|---|---|
| Surface active agent: W-6 | $5.0 \times 10^{-3}$ |
| High-boiling organic solvent: Oil-1 | 0.06 |
| Potassium sulfate | 0.50 |
| Sodium hydroxide | 0.09 |
| Third Layer | |
| Binder: acid-processed gelatin (isoelectric point 9.0) | 5.00 |
| Surface active agent: W-3 | 0.02 |
| Potassium sulfate | 0.43 |
| Sodium hydroxide | 0.08 |
| Fourth Layer | |
| Binder: acid-processed gelatin (isoelectric point 9.0) | 0.80 |
| Matting agent: B-1 (av. particle diameter 2.0 $\mu$m) | 0.02 |
| Matting agent: B-2 (av. particle diameter 2.3 $\mu$m) | 0.02 |
| Hardener: H-1 | 0.35 |
| Surface active agent: W-3 | 0.03 |
| Surface active agent: W-2 | $4.0 \times 10^{-3}$ |

Samples 801 to 804 were evaluated in the same manner as Example 5 and Example 6, and the similar results were obtained.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color reversal photographic light-sensitive material, comprising a blue-sensitive emulsion layer unit, a green-sensitive emulsion layer unit, and a red-sensitive emulsion layer unit, on a transparent support, each unit comprising at least one light-sensitive silver halide emulsion layer;

wherein the said light-sensitive material comprises an interlayer effect-controlling means; and wherein, when the said light-sensitive material is exposed to light of "a skin tone" and "a red-tint skin tone," each of which has the spectral distribution of Table 1, and is then subjected to development, the C* value represented by CIE Lab values of the image of the "skin tone" that is reproduced by the light-sensitive material, is 23 or more, but 35 or less, when L* is in the range of from 40 to 70, and the C* value represented by CIE Lab values of the image of the "red-tint skin tone" that is reproduced by the light-sensitive material, is 20 or more, but 30 or less at L*=20, and 30 or more, but 40 or less at L*=40

TABLE 1

Spectral Distribution

| Wavelength (nm) | Spectral reflectance: Skin tone | Spectral reflectance: Red-tint skin tone |
|---|---|---|
| 400 | 0.1687 | 0.1315 |
| 405 | 0.1621 | 0.1203 |
| 410 | 0.1611 | 0.1204 |
| 415 | 0.1577 | 0.1192 |
| 420 | 0.1560 | 0.1191 |
| 425 | 0.1570 | 0.1201 |
| 430 | 0.1605 | 0.1195 |

TABLE 1-continued

| Spectral Distribution | | |
|---|---|---|
| | Spectral reflectance | |
| Wavelength (nm) | Skin tone | Red-tint skin tone |
| 435 | 0.1675 | 0.1254 |
| 440 | 0.1809 | 0.1311 |
| 445 | 0.1937 | 0.1360 |
| 450 | 0.2044 | 0.1400 |
| 455 | 0.2105 | 0.1440 |
| 460 | 0.2184 | 0.1495 |
| 465 | 0.2223 | 0.1554 |
| 470 | 0.2279 | 0.1654 |
| 475 | 0.2337 | 0.1716 |
| 480 | 0.2397 | 0.1763 |
| 485 | 0.2439 | 0.1798 |
| 490 | 0.2490 | 0.1862 |
| 495 | 0.2546 | 0.1996 |
| 500 | 0.2625 | 0.2090 |
| 505 | 0.2685 | 0.2149 |
| 510 | 0.2802 | 0.2195 |
| 515 | 0.2853 | 0.2203 |
| 520 | 0.2893 | 0.2160 |
| 525 | 0.2931 | 0.2050 |
| 530 | 0.2932 | 0.1927 |
| 535 | 0.2967 | 0.1839 |
| 540 | 0.2993 | 0.1797 |
| 545 | 0.2994 | 0.1816 |
| 550 | 0.2999 | 0.1872 |
| 555 | 0.3022 | 0.1968 |
| 560 | 0.3041 | 0.2016 |
| 565 | 0.3056 | 0.1976 |
| 570 | 0.3103 | 0.1902 |
| 575 | 0.3095 | 0.1803 |
| 580 | 0.3136 | 0.1827 |
| 585 | 0.3272 | 0.2112 |
| 590 | 0.3450 | 0.2616 |
| 595 | 0.3630 | 0.3217 |
| 600 | 0.3841 | 0.3743 |
| 605 | 0.3970 | 0.4123 |
| 610 | 0.4106 | 0.4475 |
| 615 | 0.4187 | 0.4690 |
| 620 | 0.4273 | 0.4950 |
| 625 | 0.4398 | 0.5162 |
| 630 | 0.4458 | 0.5268 |
| 635 | 0.4548 | 0.5390 |
| 640 | 0.4615 | 0.5458 |
| 645 | 0.4755 | 0.5712 |
| 650 | 0.4796 | 0.5824 |
| 655 | 0.4858 | 0.5848 |
| 660 | 0.4913 | 0.5910 |
| 665 | 0.4988 | 0.6030 |
| 670 | 0.5041 | 0.6079 |
| 675 | 0.5034 | 0.6058 |
| 680 | 0.4991 | 0.6067 |
| 685 | 0.5043 | 0.6112 |
| 690 | 0.5072 | 0.6122 |
| 695 | 0.5163 | 0.6171 |
| 700 | 0.5189 | 0.6165. |

2. The silver halide color reversal photographic light-sensitive material as claimed in claim 1, wherein, for the characteristic curves of each of the color-sensitive emulsion layer units, the point-gamma value at the color density of 2.0 is 1.8 or more, but 2.5 or less, the point-gamma value at the color density of 1.0 is 1.3 or more, but 1.8 or less, and the point-gamma value at the color density of 0.5 is 0.7 or more, but 1.1 or less.

3. The silver halide color reversal photographic light-sensitive material according to claim 2, wherein the point-gamma value at the color density of 2.0 is 1.8 or more but 2.3 or less, the point-gamma value at the color density of 1.0 is 1.3 or more but 1.7 or less, and the point-gamma value at the color density of 0.5 is 0.8 or more, but 1.0 or less.

4. The silver halide color reversal photographic light-sensitive material as claimed in claim 1, wherein, when the light-sensitive material is exposed to light of a "gray" having the spectral distribution of Table 2, and is then subjected to development, the C* value represented by CIE Lab values of the image of the "gray" that is reproduced by the light-sensitive material, is 0 or more, but 10 or less, when L* is in the range of 10 or more, but 80 or less

TABLE 2

| Spectral Distribution | |
|---|---|
| Wavelength (nm) | Spectral reflectance Gray |
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874. |

5. The silver halide color reversal photographic light-sensitive material according to claim 4, wherein the C* value represented by CIE Lab values of the image of the "gray" that is reproduced by the light-sensitive material is 0 or more, but 7 or less, when L* is in the range of 10 or more, but 80 or less.

6. The silver halide color reversal photographic light-sensitive material as claimed in claim 1, wherein silver halide grains whose surface and/or interior are fogged, are incorporated in at least one layer of the color-sensitive emulsion layer unit, and/or at least one layer adjacent to the color-sensitive emulsion layer unit.

7. The silver halide color reversal photographic light-sensitive material as claimed in claim 1, wherein a colloidal silver is added to at least one layer of the color-sensitive emulsion layer unit and/or at least one layer adjacent to the color-sensitive emulsion layer unit.

8. The silver halide color reversal photographic light-sensitive material as claimed in claim 1, wherein internal latent image-type silver halide grains are incorporated in at least one layer of the color-sensitive emulsion layer unit.

9. The silver halide color reversal photographic light-sensitive material according to claim 1, wherein the C* value represented by CIE Lab values of the image of the "skin tone" that is reproduced by the light-sensitive material is 25 or more, but 35 or less, when L* is in the range of from 40 to 70, and the C* value represented by CIE Lab values of the image of the "red-tint skin tone" that is reproduced by the light-sensitive material is 20 or more, but 28 or less, at L*=20, and 30 or more, but 38 or less at L*=40.

10. A silver halide color reversal photographic light-sensitive material, comprising a blue-sensitive emulsion layer unit, a green-sensitive emulsion layer unit, and a red-sensitive emulsion layer unit, on a transparent support, each unit comprising at least one light-sensitive silver halide emulsion layer;

wherein the light-sensitive material comprises an inter-layer effect-controlling means; and wherein, when the light-sensitive material is exposed to light having the spectral distribution of Table 3 of "a skin tone" and "a red-tint skin tone," and is then subjected to development, the standard deviation of hue angle in the CIE Lab color specification system of the image of the "skin tone" and the image of the "red-tint skin tone", that are reproduced by the light-sensitive material, is within 1.0, respectively, in the range of L*=20 to 70, and the maximum difference in the hue angle in the CIE Lab color specification system between the image of the "skin tone" and the image of the "red-tint skin tone", that are reproduced by the light-sensitive material, is within 30° in the range of L*=20 to 70

TABLE 3

| Spectral Distribution | | |
|---|---|---|
| | Spectral reflectance | |
| Wavelength (nm) | Skin tone | Red-tint skin tone |
| 400 | 0.1687 | 0.1315 |
| 405 | 0.1621 | 0.1203 |
| 410 | 0.1611 | 0.1204 |
| 415 | 0.1577 | 0.1192 |
| 420 | 0.1560 | 0.1191 |
| 425 | 0.1570 | 0.1201 |
| 430 | 0.1605 | 0.1195 |
| 435 | 0.1675 | 0.1254 |

TABLE 3-continued

| Spectral Distribution | | |
|---|---|---|
| | Spectral reflectance | |
| Wavelength (nm) | Skin tone | Red-tint skin tone |
| 440 | 0.1809 | 0.1311 |
| 445 | 0.1937 | 0.1360 |
| 450 | 0.2044 | 0.1400 |
| 455 | 0.2105 | 0.1440 |
| 460 | 0.2184 | 0.1495 |
| 465 | 0.2223 | 0.1554 |
| 470 | 0.2279 | 0.1654 |
| 475 | 0.2337 | 0.1716 |
| 480 | 0.2397 | 0.1763 |
| 485 | 0.2439 | 0.1798 |
| 490 | 0.2490 | 0.1862 |
| 495 | 0.2546 | 0.1996 |
| 500 | 0.2625 | 0.2090 |
| 505 | 0.2685 | 0.2149 |
| 510 | 0.2802 | 0.2195 |
| 515 | 0.2853 | 0.2203 |
| 520 | 0.2893 | 0.2160 |
| 525 | 0.2931 | 0.2050 |
| 530 | 0.2932 | 0.1927 |
| 535 | 0.2967 | 0.1839 |
| 540 | 0.2993 | 0.1797 |
| 545 | 0.2994 | 0.1816 |
| 550 | 0.2999 | 0.1872 |
| 555 | 0.3022 | 0.1968 |
| 560 | 0.3041 | 0.2016 |
| 565 | 0.3056 | 0.1976 |
| 570 | 0.3103 | 0.1902 |
| 575 | 0.3095 | 0.1803 |
| 580 | 0.3136 | 0.1827 |
| 585 | 0.3272 | 0.2112 |
| 590 | 0.3450 | 0.2616 |
| 595 | 0.3630 | 0.3217 |
| 600 | 0.3841 | 0.3743 |
| 605 | 0.3970 | 0.4123 |
| 610 | 0.4106 | 0.4475 |
| 615 | 0.4187 | 0.4690 |
| 620 | 0.4273 | 0.4950 |
| 625 | 0.4398 | 0.5162 |
| 630 | 0.4458 | 0.5268 |
| 635 | 0.4548 | 0.5390 |
| 640 | 0.4615 | 0.5458 |
| 645 | 0.4755 | 0.5712 |
| 650 | 0.4796 | 0.5824 |
| 655 | 0.4858 | 0.5848 |
| 660 | 0.4913 | 0.5910 |
| 665 | 0.4988 | 0.6030 |
| 670 | 0.5041 | 0.6079 |
| 675 | 0.5034 | 0.6058 |
| 680 | 0.4991 | 0.6067 |
| 685 | 0.5043 | 0.6112 |
| 690 | 0.5072 | 0.6122 |
| 695 | 0.5163 | 0.6171 |
| 700 | 0.5189 | 0.6165. |

11. The silver halide color reversal photographic light-sensitive material as claimed in claim 10, wherein, when the light-sensitive material is exposed to light having the spectral distribution of Table 4 of a "gray", and is then subjected to development, the C* value represented by CIE Lab values of the image of the "gray" that is reproduced by the light-sensitive material, is 0 or more, but 10 or less, in the range of L*=10 to 80

TABLE 4

| Spectral Distribution | |
|---|---|
| Wavelength (nm) | Spectral reflectance Gray |
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874. |

12. The silver halide color reversal photographic light-sensitive material according to claim 11, wherein the C* value represented by CIE Lab values of the image of the "gray" that is reproduced by the light-sensitive material, is 0 or more, but 7 or less, in the range of L*=10 to 80.

13. The silver halide color reversal photographic light-sensitive material as claimed in claim 10, wherein silver halide grains whose surface and/or interior are fogged, are incorporated in at least one layer of the color-sensitive emulsion layer unit, and/or at least one layer adjacent to the color-sensitive emulsion layer unit.

14. The silver halide color reversal photographic light-sensitive material as claimed in claim 10, wherein a colloidal silver is added to at least one layer of the color-sensitive emulsion layer unit and/or at least one layer adjacent to the color-sensitive emulsion layer unit.

15. The silver halide color reversal photographic light-sensitive material as claimed in claim 10, wherein internal latent image-type silver halide grains are incorporated in at least one layer of the color-sensitive emulsion layer unit.

16. The silver halide color reversal photographic light-sensitive material according to claim 10, wherein the standard deviation of hue angle in the CIE Lab color specification system of the image of the "skin tone" and the image of the "red-tint skin tone", that are reproduced by the light-sensitive material, is within 0.6, respectively, in the range of L*=20 to 70, and the maximum difference in the hue angle in the CIE Lab color specification system between the image of the "skin tone" and the image of the "red-tint skin tone", that are reproduced by the light-sensitive material is within 25° in the range of L* =20 to 70.

17. The silver halide color reversal photographic light-sensitive material according to claim 10, wherein the value of the hue angle represented by CIE Lab values of the "skin tone" image, that is reproduced by the light-sensitive material is from 50° to 70° in the range of L*=20 to 70, and the value of the hue angle represented by CIE Lab values of the "red-tint skin tone" image, that is reproduced by the light-sensitive material is from 40° to 60° in the range of 20 to 70.

18. The silver halide color reversal photographic light-sensitive material according to claim 10, wherein the C* value represented by the CIE Lab values of the "skin tone" image that is reproduced by the light-sensitive material is 26 or more, but 35 or less, in the range of L*=40 to 70.

19. The silver halide color reversal photographic light-sensitive material according to claim 10, wherein the C* value represented by the CIE Lab values of the "red-tint skin tone" image that is reproduced by the light-sensitive material is 20 or more, but 30 or less, at L*=20.

20. The silver halide color reversal photographic light-sensitive material according to claim 7, wherein the C* value represented by the CIE Lab values of the "red-tint skin tone" image that is reproduced by the light-sensitive material is 30 or more, but 40 or less, at L*=40.

* * * * *